US010763624B1

(12) United States Patent
Henry et al.

(10) Patent No.: US 10,763,624 B1
(45) Date of Patent: Sep. 1, 2020

(54) RECEPTACLE CONNECTOR HAVING GROUND BUS INSERT

(71) Applicant: TE CONNECTIVITY CORPORATION, Berwyn, PA (US)

(72) Inventors: Randall Robert Henry, Lebanon, PA (US); Michael John Phillips, Camp Hill, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 16/386,394

(22) Filed: Apr. 17, 2019

(51) Int. Cl.

| | |
|---|---|
| ***H01R 13/648*** | (2006.01) |
| ***H01R 13/6585*** | (2011.01) |
| ***H01R 13/03*** | (2006.01) |
| ***H01R 13/405*** | (2006.01) |
| ***H01R 13/502*** | (2006.01) |

(52) U.S. Cl.
CPC ..... *H01R 13/6585* (2013.01); *H01R 13/035* (2013.01); *H01R 13/405* (2013.01); *H01R 13/502* (2013.01)

(58) Field of Classification Search
CPC ..... H01R 13/6585; H01R 13/035; H01R 13/405; H01R 13/502
USPC ..... 439/607.1, 607.05
See application file for complete search history.

(56) References Cited

U.S. PATENT DOCUMENTS

| | | | | |
|---|---|---|---|---|
| 7,766,560 | B2 | 8/2010 | Dangelmaier et al. | |
| 7,993,147 | B2 | 8/2011 | Cole et al. | |
| 8,932,080 | B2 | 1/2015 | Chang et al. | |
| 9,559,465 | B2 * | 1/2017 | Phillips | H01R 13/6471 |
| 9,583,851 | B2 * | 2/2017 | Wormsbecher | H01R 12/7076 |
| 10,050,363 | B2 * | 8/2018 | Mundt | H01R 13/6587 |

* cited by examiner

*Primary Examiner* — Khiem M Nguyen

(57) ABSTRACT

A receptacle connector includes a contact module assembly and a front housing receiving the contact module assembly. The contact module assembly includes first and second contact modules and a ground bus insert. The contact modules include dielectric frames holding contact lead-frames including signal contacts and ground contacts. The first and second contact modules are stacked side by side with the ground bus insert therebetween. The ground bus insert includes ground conductors electrically connected together. The ground conductors include first and second side rails electrically connected to corresponding first and second ground contacts. The front housing has a receptacle slot receiving the signal contacts and ground contacts positioned to mate with the plug connector.

20 Claims, 13 Drawing Sheets

RECEPTACLE CONNECTOR HAVING GROUND BUS INSERT

BACKGROUND OF THE INVENTION

The subject matter herein relates generally to receptacle connectors.

Receptacle connectors are used with an electrical connector system for electrically connecting a circuit board with another component, such as a plug connector. The receptacle connector includes signal contacts that provide electrical paths between the plug connector and the circuit board. At hired data rates, signal integrity of the receptacle connector is problematic. Ground contacts are typically provided between signal contacts to provide electrical shielding through the receptacle connector. However, routing of signal contacts and ground contacts through the connector may be difficult and increase the overall size of the receptacle connector. In the data communication industry, there is a desire for decreasing footprints of receptacle connectors on the circuit boards. However, smaller footprints lead to signal integrity problems within the electrical connector system.

A need remains for a cost effective and reliable receptacle connector for an electrical connector system.

BRIEF DESCRIPTION OF THE INVENTION

In one embodiment, a receptacle connector is provided including a contact module assembly and a front housing having a cavity receiving the contact module assembly. The contact module assembly includes a first contact module, a second contact module, and a ground bus insert. The first contact module includes a first dielectric frame holding a first contact leadframe including first signal contacts and first ground contacts. The second contact module includes a second dielectric frame holding a second contact leadframe including second signal contacts and second ground contacts. The first and second contact modules are stacked side by side with the ground bus insert between the first and second contact modules. The ground bus insert includes ground conductors electrically connected together. The ground conductors include first side rails and second side rails. The first side rails are electrically connected to corresponding first ground contacts. The second side rails are electrically connected to corresponding second ground contacts. The front housing has a receptacle slot at a front of the front housing configured to receive a plug connector. The first and second signal contacts and the first and second ground contacts are received in the receptacle slot to mate with the plug connector.

In another embodiment, a receptacle connector is provided including a contact module assembly including a first contact module, a second contact module, and a ground bus insert between the first contact module and the second contact module. The first contact module has a first dielectric frame holding a first contact leadframe having first signal contacts and first ground contacts. The first signal contacts have mating ends and mounting ends and the first ground contacts having mating ends and mounting ends. The mating ends of the first signal contacts are configured for mating with mating contacts of a plug connector. The mounting ends of the first signal contacts are configured for mounting to a circuit board. The second contact module has a second dielectric frame holding a second contact leadframe having second signal contacts and second ground contacts. The second signal contacts have mating ends and mounting ends and the second ground contacts have mating ends and mounting ends. The mating ends of the second signal contacts are configured for mating with mating contacts of the plug connector. The mounting ends of the second signal contacts are configured for mounting to the circuit board. The first and second contact modules are stacked side by side with the mating ends of the first and second signal contacts extending forward from the first and second dielectric frames in a first row and a second row on opposite sides of a gap configured to receive the plug connector. The ground bus insert includes ground conductors electrically connected together. The ground conductors include first side rails and second side rails. The first side rails are electrically connected to corresponding first ground contacts. The second side rails are electrically connected to corresponding second ground contacts. The receptacle connector includes a front housing having a cavity receiving the contact module assembly. The front housing has a receptacle slot at a front of the front housing configured to receive the plug connector. The mating ends of the first and second signal contacts are received in the receptacle slot to mate with the plug connector. The receptacle connector includes an outer housing having a chamber receiving the front housing. The outer housing is conductive and provides electrical shielding around the chamber.

In a further embodiment, an electrical connector system includes a plug connector and a receptacle connector mated with the plug connector. The plug connector has a circuit card having an edge extending between a first surface and a second surface. The circuit card has first plug contacts on the first surface and second plug contacts on the second surface. The receptacle connector includes a contact module assembly including a first contact module, a second contact module, and a ground bus insert. The first contact module includes a first dielectric frame holding a first contact leadframe including first signal contacts and first ground contacts. The second contact module includes a second dielectric frame holding a second contact leadframe including second signal contacts and second ground contacts. The first and second contact modules are stacked side by side with the ground bus insert between the first and second contact modules. The ground bus insert includes ground conductors electrically connected together. The ground conductors include first side rails and second side rails. The first side rails are electrically connected to corresponding first ground contacts and the second side rails are electrically connected to corresponding second ground contacts. The receptacle connector includes a front housing having a cavity receiving the contact module assembly. The front housing has a receptacle slot at a front of the front housing receiving the circuit card of the plug connector. The first and second signal contacts and the first and second ground contacts have mating ends received in the receptacle slot. The mating ends of the first signal contacts and the first ground contacts are arranged on a first side of the receptacle slot to mate with the first plug contacts. The mating ends of the second signal contacts and the second ground contacts are arranged on a second side of the receptacle slot to mate with the second plug contacts. The receptacle connector includes an outer housing having a chamber receiving the front housing. The outer housing is conductive and provides electrical shielding around the chamber.

DETAILED DESCRIPTION OF THE INVENTION

Figure 1:
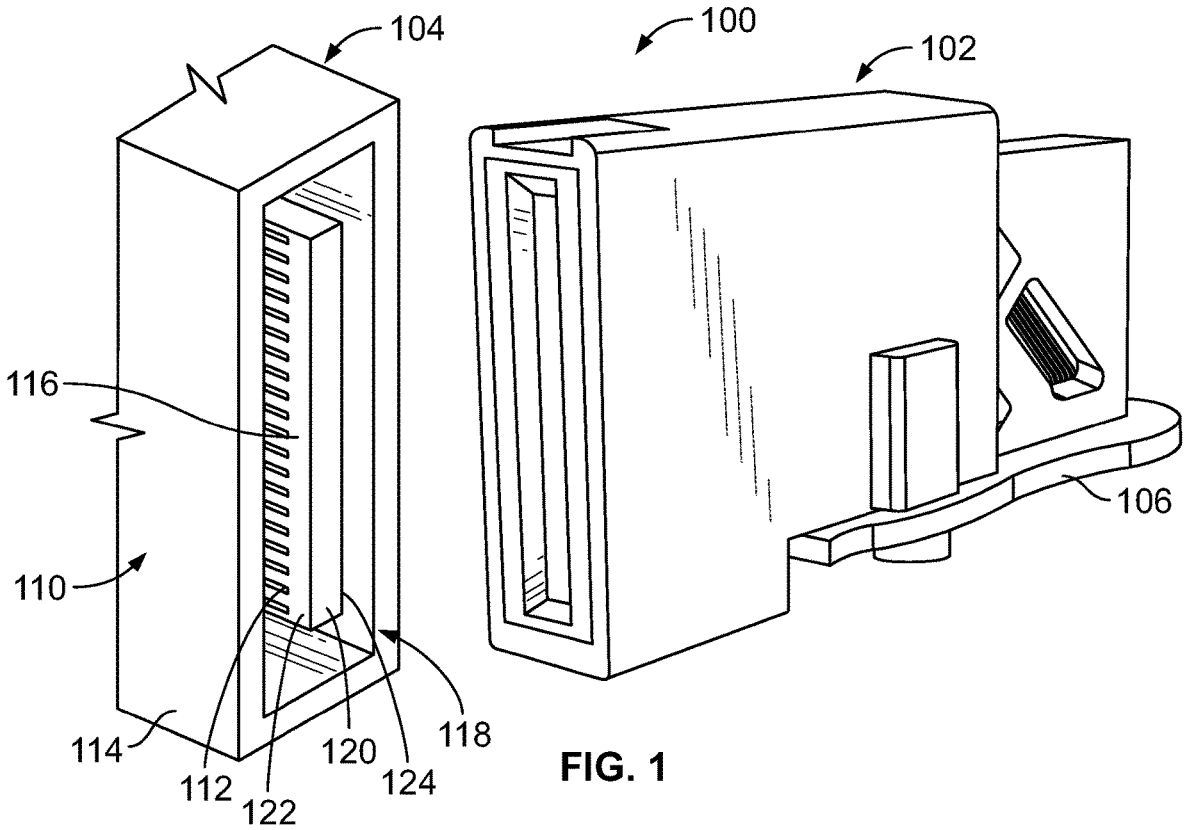
FIG. 1 is a perspective view of an electrical connector system having a receptacle connector in accordance with an exemplary embodiment.

FIG. 1 is a perspective view of an electrical connector system 100 in accordance with an exemplary embodiment. The electrical connector system 100 includes a receptacle connector 102 and a plug connector 104. In the illustrated embodiment, the receptacle connector 102 is mounted to a circuit board 106; however, the receptacle connector 102 may be provided at an end of a cable or cable bundle in an alternative embodiment. In the illustrated embodiment, the plug connector 104 is provided at an end of a cable (not shown); however, the plug connector 104 may be mounted to a circuit board in an alternative embodiment.

The receptacle connector 102 is used to electrically connect the plug connector 104 and the circuit board 106. The receptacle connector 102 may transmit data signals and/or power between the plug connector 104 and the circuit board 106. In the illustrated embodiment, the receptacle connector 102 is an orthogonal connector having the mating interface of the receptacle connector 102 oriented orthogonal to the circuit board 106. For example, in the illustrated embodiment, the mating interface of the receptacle connector 102 is oriented vertically and the circuit board 106 is oriented horizontally. Other orientations are possible in alternative embodiments. In an exemplary embodiment, the receptacle connector 102 is a card edge connector having a receptacle slot configured to receive the plug connector 104. Other types of receptacle connectors 102 may be used in alternative embodiments.

The plug connector 104 includes a plug module 110 holding a plurality of plug contacts 112. In the illustrated embodiment, the plug module 110 includes a plug housing 114 holding a circuit card 116. The plug module 110 has a mating end 118 and the circuit card 116 is provided at the mating end 118. The circuit card 116 has an edge 120 extending between a first surface 122 and a second surface 124. The plug contacts 112 are provided on the circuit card 116 at or near the edge 120. In an exemplary embodiment, the plug contacts 112 are provided on the first surface 122 and the second surface 124. The plug contacts 112 may be circuits of the circuit card 116, such as including pads, traces, vias, and the like.

Figure 2:
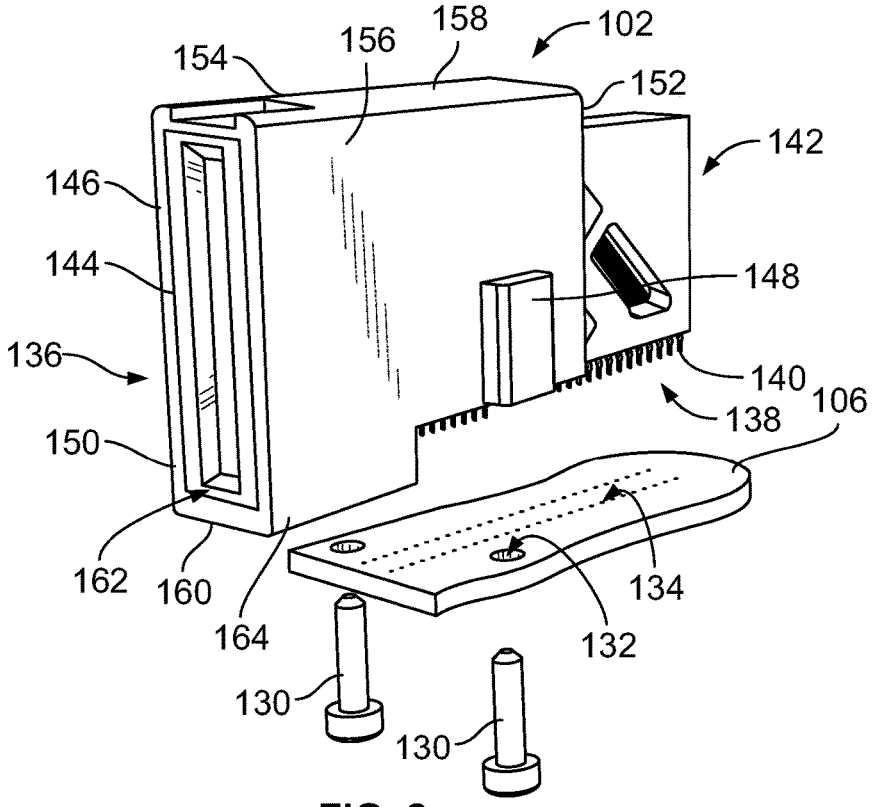
FIG. 2 is an exploded view of the receptacle connector in accordance with an exemplary embodiment.

FIG. 2 is an exploded view of the receptacle connector 102 in accordance with an exemplary embodiment. The receptacle connector 102 is configured to be mounted to the circuit board 106. In an exemplary embodiment, fasteners 130 are used to secure the receptacle connector 102 to the circuit board 106. The fasteners 130 may pass through openings 132 and the circuit board 106. The fasteners 130 may be threaded fasteners; however, other types of fasteners may be used to secure the receptacle connector 102 to the circuit board 106. In an exemplary embodiment, the circuit board 106 includes a plurality of vias 134 configured to be electrically connected to contacts 140 of the receptacle connector 102. For example, the contacts 140 may be press-fit into the vias 134. The contacts 140 may be soldered to the vias 134 in various embodiments. In alternative embodiments, the receptacle connector 102 may be surface mounted to the circuit board 106, such as at solder pads (not shown) on the surface of the circuit board 106.

The receptacle connector 102 extends between a mating end 136 and a mounting end 138. The contacts 140 extend between the mating end 136 and the mounting end 138 for mating with the plug connector 104 and mounted to the circuit board 106, respectively. In the illustrated embodiment, the mating end 136 is orthogonal to the mounting end 138. For example, the mating end 136 is provided at a front of the receptacle connector 102 and the mounting end 138 is provided at a bottom of the receptacle connector 102. However, other orientations are possible in alternative embodiments.

The receptacle connector 102 includes a contact module assembly 142, a front housing 144 received in the contact module assembly 142 and an outer housing 146 received in the front housing 144. The front housing 144 and the contact module assembly 142 are held in the outer housing 146 for mating with the plug connector 104 and the circuit board 106. In an exemplary embodiment, the outer housing 146 is secured to the circuit board 106 using the fasteners 130. For example, the outer housing 146 includes mounting lugs 148 that receive the fasteners 130. The mounting lugs 148 may have threaded openings in various embodiments.

In an exemplary embodiment, the outer housing 146 is manufactured from a conductive material, such as a metal material to provide electrical shielding for the receptacle connector 102. The outer housing 146 provides electrical shielding around the contacts 140. The outer housing 146 provides electrical shielding at the mating interface with the plug connector 104. In an exemplary embodiment, the outer housing 146 is a diecast housing. However, the outer housing 146 may be manufactured by other processes, such as molding, conductive plating of a dielectric housing, or attaching stamped and formed shields to a plastic housing.

The outer housing 146 extends between a front 150 and a rear 152. The outer housing 146 includes a first side 154 and a second side 156 extending between the front 150 and the rear 152. The outer housing 146 includes a first end 158 and a second end 160 extending between the first side 154 and the second side 156 and extending between the front 150 and the rear 152. In an exemplary embodiment, the first end 158 may define a top of the outer housing 146 and the second end 160 may define a bottom of the outer housing 146. However, other orientations are possible in alternative embodiments.

The outer housing 146 includes a chamber 162 defined between the sides 154, 156 and the ends 158, 160. The chamber 162 extends between the front 150 and the rear 152. The chamber 162 receives the front housing 144 and the contact module assembly 142. In an exemplary embodiment, the outer housing 146 includes a hood 164 at the front 150. The hood 164 is defined by the first side 154, the second side 156, the first end 158 and the second end 160. The hood 164 extends entirely circumferentially around the chamber 162. Optionally, the hood 164 may only extend a portion of the length of the outer housing 146 between the front 150 and the rear 152. For example, the second end 160 may be open rearward of the hood 164 in various embodiments.

In an exemplary embodiment, the contact module assembly 142 extends from the chamber 162 rearward from the rear 152 of the outer housing 146. However, in alternative embodiments, the contact module assembly 142 may be contained within the chamber 162. In an exemplary embodiment, the contacts 140 extend from the chamber 162 at the bottom for mounting to the circuit board 106. The contact module assembly 142 and the front housing 144 are loaded into the outer housing 146 through the bottom; however, the contact module assembly 142 and the front housing 144 may be loaded into the outer housing 146 in other directions, such as being rear loaded into the outer housing 146. The outer housing 146 is open at the front 150 to provide access to the front housing 144 and the contact module assembly 142. For example, the receptacle connector 102 may form a receptacle slot at the mating end 136 for receiving the circuit card 116 (shown in FIG. 1) of the plug connector 104.

Figure 3:
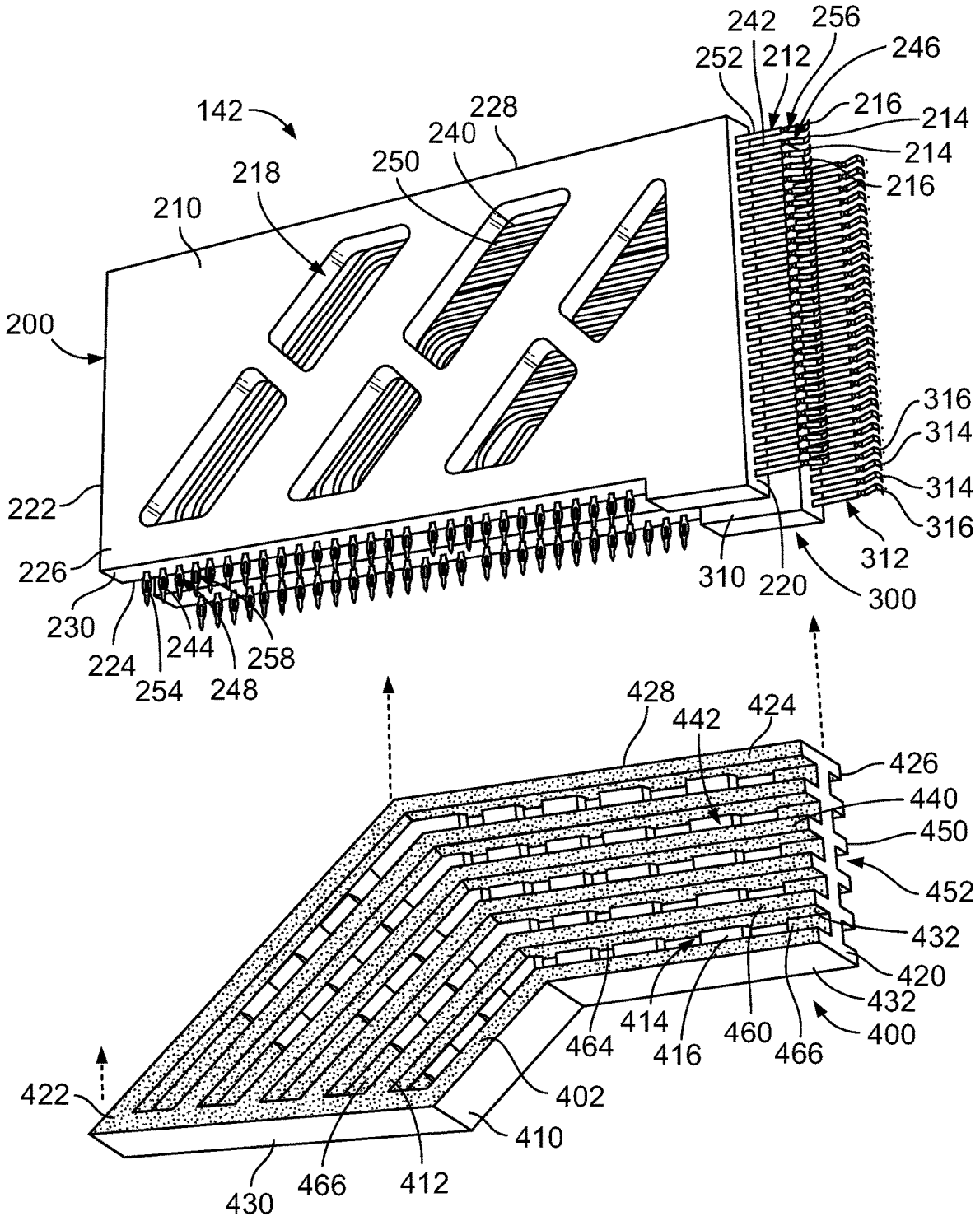
FIG. 3 is a bottom perspective, exploded view of a contact module assembly of the receptacle connector in accordance with an exemplary embodiment.

FIG. 3 is a bottom perspective, exploded view of the contact module assembly 142 of the receptacle connector 102 in accordance with an exemplary embodiment. The contact module assembly 142 includes a first contact module 200, a second contact module 300, and a ground bus insert 400 configured to be positioned between the first contact module 200 and the second contact module 300. The ground bus insert 400 forms a grounding structure of the contact module assembly 142. When assembled, the first contact module 200, the ground bus insert 400, and the second contact module 300 are arranged in a stacked configuration. The ground bus insert 400 is sandwiched between the first contact module 200 and the second contact module 300. In an exemplary embodiment, the ground bus insert 400 is located within the first contact module 200 and located within the second contact module 300 such that the first and second contact modules 200, 300 surround or envelop the ground bus insert 400.

The first contact module 200 includes a first dielectric frame 210 holding a first contact lead frame 212. The contact lead frame 212 includes first signal contacts 214 and first ground contacts 216. The signal contacts 214 and the ground contacts 216 are at least partially encased or enclosed in the dielectric frame 210. For example, the dielectric frame 210 may be overmolded around the signal contacts 214 and the ground contacts 216 to form an overmolded wafer. Portions of the signal contacts 214 and the ground contacts 216 are exposed through openings 218 in the dielectric frame 210. For example, the signal contacts 214 and the ground contacts 216 may be exposed to air for impedance control of the signals through the first contact module 200. The ground contacts 216 may be exposed through the dielectric frame 210 for interfacing with the ground bus insert 400. For example, the ground bus insert 400 may be electrically connected to corresponding ground contacts 216 for busing or commoning the ground contacts 216.

The dielectric frame 210 has a front 220 and a rear 222. The dielectric frame 210 has a first side 224 and a second side 226. The dielectric frame 210 has a first end 228 and a second end 230. Optionally, the first end 228 may define a top of the dielectric frame 210 and the second end 230 may define a bottom of the dielectric frame 210. The first side 224 defines an inner side configured to face the second contact module 300. The second side 226 defines an outer side facing away from the second contact module 300. The ground bus insert 400 is coupled to the first side 224 of the dielectric frame 210. For example, the first side 224 may have a pocket or cavity that receives a portion of the ground bus insert 400.

In an exemplary embodiment, the contact lead frame 212 is stamped and formed from a metal sheet to form the signal contacts 214 and the ground contacts 216. The ground contacts 216 may be interspersed between corresponding signal contacts 214. For example, the ground contacts 216 and the signal contacts 214 may be arranged in an alternating sequence. In other various embodiments, the signal contacts 214 may be arranged in pairs configured to convey differential signals and the ground contacts 216 may be arranged between the pairs of signal contacts 214. Other arrangements are possible in alternative embodiments.

The signal contacts 214 have transition portions 240 extending between mating ends 242 and mounting ends 244 of the signal contacts 214. The mating ends 242 extend forward from the front 220 of the dielectric frame 210 for mating with the plug connector 104 (shown in FIG. 1). For example, the mating ends 242 include spring beams 246 cantilevered forward from the front 220 of the dielectric frame 210. The spring beams 246 are deflectable and configured for mating with the circuit card 116 (shown in FIG. 1) of the plug connector 104. Optionally, the spring beams 246 may have curved mating interfaces at or near distal ends of the spring beams 246. The mounting ends 244 extend from the second end 230 of the dielectric frame 210, such as in a downward direction, for mounting to the circuit board 106. For example, the mounting ends 244 include compliant pins 248, such as eye-of-the-needle pins, configured to be press-fit into the vias 134 (shown in FIG. 2) of the circuit board 106. Other types of mounting ends may be provided in alternative embodiments.

The ground contacts 216 have transition portions 250 extending between mating ends 252 and mounting ends 254 of the ground contacts 216. The mating ends 252 extend forward from the front 220 of the dielectric frame 210 for mating with the plug connector 104 (shown in FIG. 1). For example, the mating ends 252 include spring beams 256 cantilevered forward from the front 220 of the dielectric frame 210. The spring beams 256 are deflectable and configured for mating with the circuit card 116 (shown in FIG. 1) of the plug connector 104. Optionally, the spring beams 256 may have curved mating interfaces at or near distal ends of the spring beams 256. The mounting ends 254 extend from the second end 230 of the dielectric frame 210, such as in a downward direction, for mounting to the circuit board 106. For example, the mounting ends 254 include compliant pins 258, such as eye-of-the-needle pins, configured to be press-fit into the vias 134 (shown in FIG. 2) of the circuit board 106. Other types of mounting ends may be provided in alternative embodiments.

Figure 4:
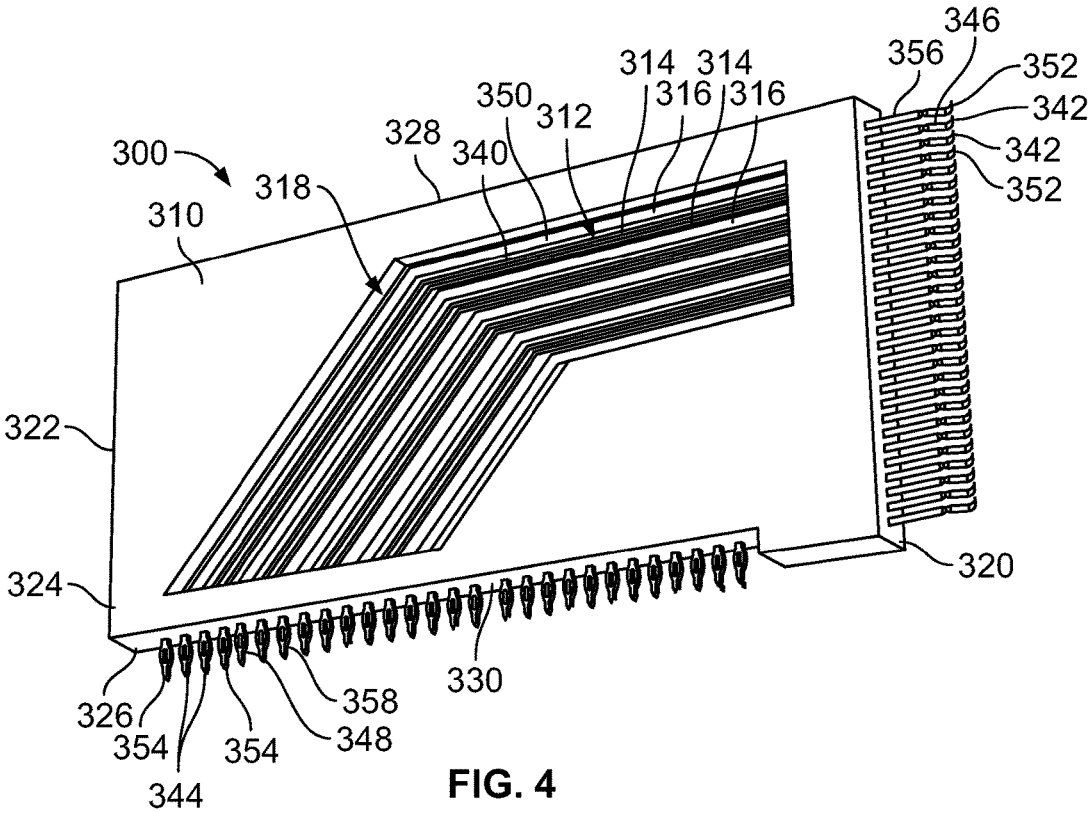
FIG. 4, which is a bottom perspective view of a contact module of the contact module assembly in accordance with an exemplary embodiment.

With additional reference to FIG. 4, which is a bottom perspective view of the second contact module 300, the second contact module 300 includes a second dielectric frame 310 holding a second contact lead frame 312. The contact lead frame 312 includes second signal contacts 314 and second ground contacts 316. The signal contacts 314 and the ground contacts 316 are at least partially encased or enclosed in the dielectric frame 310. For example, the dielectric frame 310 may be overmolded around the signal contacts 314 and the ground contacts 316 to form an overmolded wafer. Portions of the signal contacts 314 and the ground contacts 316 are exposed through openings 318 in the dielectric frame 310. For example, the signal contacts 314 and the ground contacts 316 may be exposed to air for impedance control of the signals through the second contact module 300. The ground contacts 316 may be exposed through the dielectric frame 310 for interfacing with the ground bus insert 400. For example, the ground bus insert 400 may be electrically connected to corresponding ground contacts 316 for busing or commoning the ground contacts 316.

The dielectric frame 310 has a front 320 and a rear 322. The dielectric frame 310 has a first side 324 and a second side 326. The dielectric frame 310 has a first end 328 and a second end 330. Optionally, the first end 328 may define a top of the dielectric frame 310 and the second end 330 may define a bottom of the dielectric frame 310. The first side 324 defines an inner side configured to face the first contact module 200. The second side 326 defines an outer side facing away from the first contact module 200. The ground bus insert 400 is coupled to the first side 324 of the dielectric frame 310. For example, the first side 324 may have a pocket or cavity that receives a portion of the ground bus insert 400.

In an exemplary embodiment, the contact lead frame 312 is stamped and formed from a metal sheet to form the signal contacts 314 and the ground contacts 316. The ground contacts 316 may be interspersed between corresponding signal contacts 314. For example, the ground contacts 316 and the signal contacts 314 may be arranged in an alternating sequence. In other various embodiments, the signal contacts 314 may be arranged in pairs configured to convey differential signals and the ground contacts 316 may be arranged between the pairs of signal contacts 314. Other arrangements are possible in alternative embodiments.

The signal contacts 314 have transition portions 340 extending between mating ends 342 and mounting ends 344 of the signal contacts 314. The mating ends 342 extend forward from the front 320 of the dielectric frame 310 for mating with the plug connector 104. For example, the mating ends 342 include spring beams 346 cantilevered forward from the front 320 of the dielectric frame 310. The spring beams 346 are deflectable and configured for mating with the circuit card 116 of the plug connector 104. Optionally, the spring beams 346 may have curved mating interfaces at or near distal ends of the spring beams 346. The mounting ends 344 extend from the first end 328 of the dielectric frame 310, such as in a downward direction, for mounting to the circuit board 106. For example, the mounting ends 344 include compliant pins 348, such as eye-of-the-needle pins, configured to be press-fit into the vias 134 of the circuit board 106. Other types of mounting ends may be provided in alternative embodiments.

The ground contacts 316 have transition portions 350 extending between mating ends 352 and mounting ends 354 of the ground contacts 316. The mating ends 352 extend forward from the front 320 of the dielectric frame 310 for mating with the plug connector 104 (shown in FIG. 1). For example, the mating ends 352 include spring beams 356 cantilevered forward from the front 320 of the dielectric frame 310. The spring beams 356 are deflectable and configured for mating with the circuit card 116 (shown in FIG. 1) of the plug connector 104. Optionally, the spring beams 356 may have curved mating interfaces at or near distal ends of the spring beams 356. The mounting ends 354 extend from the second end 330 of the dielectric frame 310, such as in a downward direction, for mounting to the circuit board 106. For example, the mounting ends 354 include compliant pins 358, such as eye-of-the-needle pins, configured to be press-fit into the vias 134 (shown in FIG. 3) of the circuit board 106. Other types of mounting ends may be provided in alternative embodiments.

Figure 5:
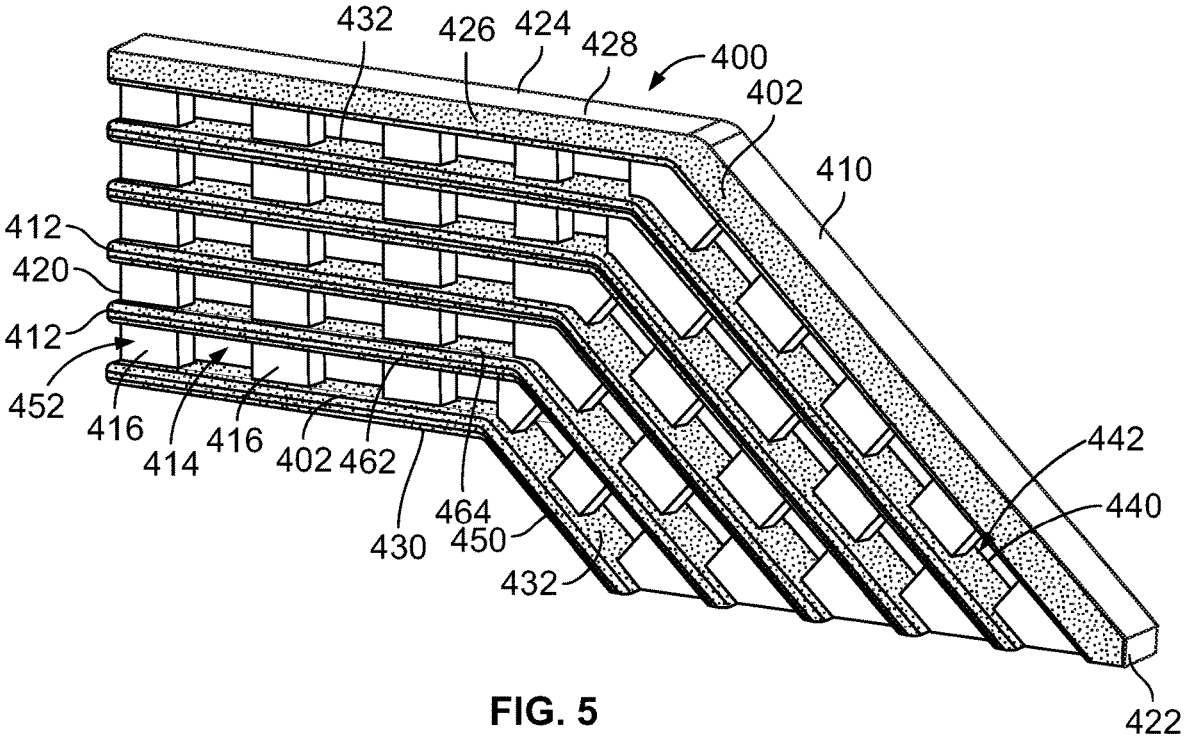
FIG. 5 is a side perspective view of a ground bus insert of the contact module assembly in accordance with an exemplary embodiment.

With additional reference to FIG. 3 and to FIG. 5, which is a side perspective view of the ground bus insert 400, the ground bus insert 400 includes ground conductors 402 electrically connected together. The ground conductors 402 are configured to be electrically connected to the first ground contacts 216 and the second ground contacts 316. The ground conductors 402 electrically bus or common the first ground contacts 216 and the second ground contacts 316.

In an exemplary embodiment, the ground bus insert 400 includes an insert frame 410 having a plurality of frame members 412 with openings 414 between the frame members 412. The frame members 412 are connected by joining walls 416. In an exemplary embodiment, the insert frame 410 is manufactured from a dielectric material, such as a plastic material. The insert frame 410 may be molded, such as by injection molding. The insert frame 410 forms a substrate or support structure for the ground conductors 402. In an exemplary embodiment, the ground conductors 402 are provided on the frame members 412 and may be provided on the joining walls 416. For example, the ground conductors 402 may be plated on the frame members 412. The ground conductors 402 may be formed by laser direct structuring the ground conductors 402 in position on the frame members 412. The ground conductors 402 may be electroplated. The ground conductors 402 may be applied by other processes in alternative embodiments, such as coating, dipping, spraying, and the like.

The insert frame 410 extends between a front 420 and a rear 422. The insert frame 410 includes a first side 424 and a second side 426. The insert frame 410 includes a first end 428 and a second end 430. Optionally, the first end 428 may be a top end and the second end 430 may be a bottom end. However, other orientations are possible in alternative embodiments. The insert frame 410 includes end walls 432 extending between the first and second sides 424, 426. The end walls 432 may be upper end walls generally facing in an upward direction or lower end walls generally facing in a downward direction.

In various embodiments, the insert frame 410 has the openings 414 between the joining walls 416. The insert frame 410 includes first tabs 440 extending between the joining walls 416 and the first side 424. First pockets 442 are defined between the corresponding tabs 440 and extend between the first side 424 and the joining walls 416. In an exemplary embodiment, the first tabs 440 are configured to be received in the first dielectric frame 210 (FIG. 3). The insert frame 410 includes second tabs 450 extending between the joining walls 416 and the second side 426. Second pockets 452 are defined between the corresponding tabs 450 and extend between the second side 426 and the joining walls 416. In an exemplary embodiment, the second tabs 450 are configured to be received in the second dielectric frame 310 (FIG. 4).

The ground conductors 402 are provided on the exterior of the frame members 412. For example, the ground conductors 402 may be attached to or applied directly on exterior surfaces of the frame members 412. The ground conductors 402 may also be applied to the first tabs 440 and/or the second tabs 450 and/or the end walls 432 and/or the joining walls 416. In an exemplary embodiment, the ground conductors 402 are provided on the first tabs 440 at the first side 424 to form first side rails 460 configured to electrically connect with corresponding first ground contacts 216 of the first contact module 200. For example, the first side rails 460 may directly engage corresponding first ground contacts 216. In an exemplary embodiment, the ground conductors 402 are provided on the second tabs 450 at the second side 426 to form second side rails 462 along the second tabs 450 configured to electrically connect with corresponding second ground contacts 316 of the second contact module 300. For example, the second side rails 462 may directly engage corresponding second ground contacts 316.

In an exemplary embodiment, the ground conductors 402 include connecting rails 464 provided on the corresponding end walls 432 between the first side rails 460 and the second side rails 462. The connecting rails 464 electrically connect the first and second side rails 460, 462. As such, the first and second side rails 460, 462 are electrically commoned or bussed by the connecting rails 464. In an exemplary embodiment, the ground conductors 402 include connecting rails 466 provided on corresponding joining walls 416 between corresponding end walls 432. The connecting rails 466 electrically connect the connecting rails 464. The connecting rails 464 provide horizontal electrical connection and the connecting rails 466 provide vertical electrical connection.

Figure 6:
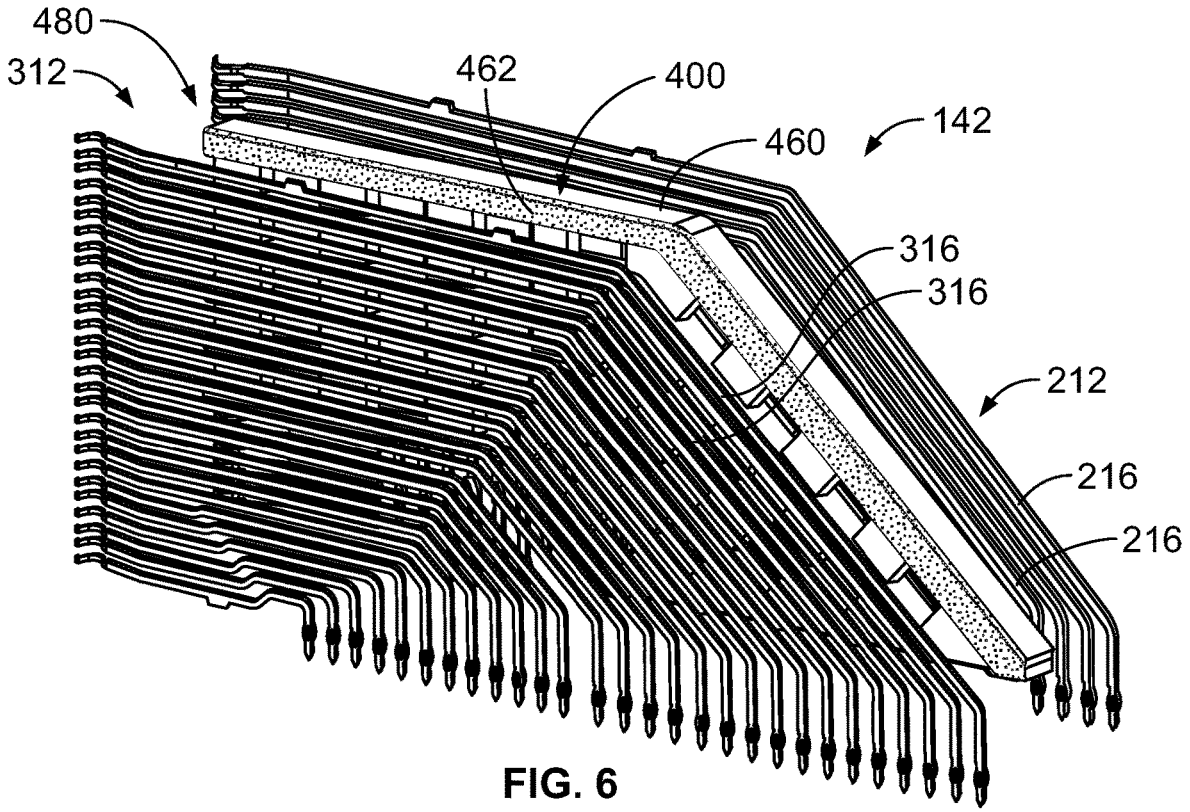
FIG. 6 is an exploded, perspective view of a portion of the contact module assembly illustrating the ground bus insert between portions of the contact modules.

FIG. 6 is an exploded, perspective view of a portion of the contact module assembly 142 illustrating the ground bus insert 400 between the first contact lead frame 212 and the second contact lead frame 312. The first dielectric frame 210 (shown in FIG. 3) and the second dielectric frame 310 (shown in FIG. 3) are removed for clarity to illustrate the contact lead frames 212, 312 relative to the ground bus insert 400. When assembled, the side rails 460, 462 are configured to be electrically connected to the ground contacts 216, 316, respectively. The ground bus insert 400 is sandwiched between the contact lead frames 212, 312 to electrically connect the ground contacts 216, 316. The first and second contact lead frames 212, 312 are separated by a gap 480 with the contacts arranged in first and second rows on opposite sides of the gap 480. The ground bus insert 400 is received in the gap 480. The circuit card 116 (shown in FIG. 1) is configured to be received in the gap 480.

Figure 7:
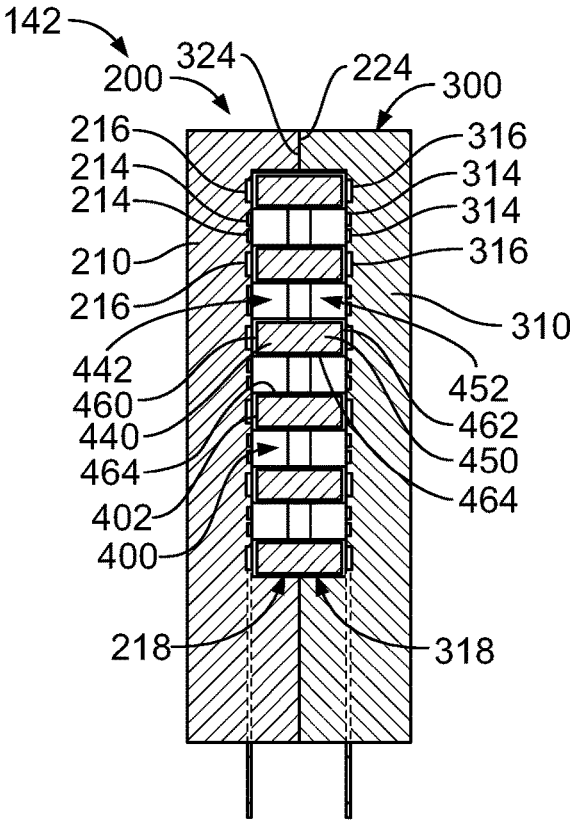
FIG. 7 is a cross-sectional view of the contact module assembly in accordance with an exemplary embodiment.

FIG. 7 is a cross-sectional view of the contact module assembly 142 in accordance with an exemplary embodiment. The ground bus insert 400 is received in the openings 218, 318 at the inner sides 224, 324 of the dielectric frames 210, 310. The inner sides 224, 324 of the dielectric frames 210, 310 abut against each other such that a portion of the ground bus insert 400 is received in the first contact module 200 and another portion of the ground bus insert 400 is received in the second contact module 300. The ground conductors 402 are used to electrically connect the first and second ground contacts 216, 316. For example, the connecting rails 464 electrically connect the first and second side rails 460, 462.

When assembled, the first tabs 440 are aligned with the first ground contacts 216. As such, the first side rails 460 on the first tabs 440 are configured to be electrically connected to the first ground contacts 216. In an exemplary embodiment, the first side rails 460 directly engage the first ground contacts 216. The first pockets 442 are aligned with the first signal contacts 214. As such, the first signal contacts 214 are electrically isolated from the ground conductors 402. When assembled, the second tabs 450 are aligned with the second ground contacts 316. As such, the second side rails 462 on the second tabs 450 are configured to be electrically connected to the second ground contacts 316. In an exemplary embodiment, the second side rails 460 to directly engage the second ground contacts 316. The second pockets 452 are aligned with the second signal contacts 314. As such, the second signal contacts 314 are electrically isolated from the ground conductors 402.

Figure 8:
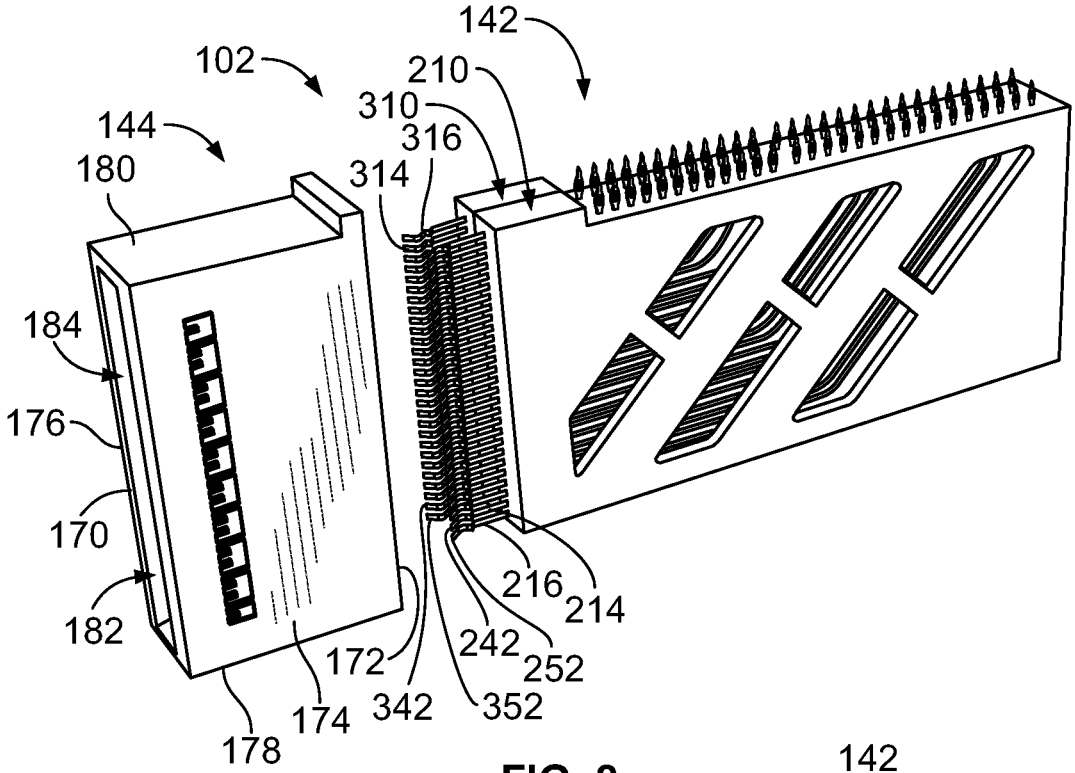
FIG. 8 is a bottom perspective view of a portion of the receptacle connector illustrating the contact module assembly poised for loading into a front housing of the receptacle connector.

FIG. 8 is a bottom perspective view of a portion of the receptacle connector 102 illustrating the contact module assembly 142 poised for loading into the front housing 144. The front housing 144 extends between a front 170 and a rear 172. The front housing 144 includes a first side 174 and a second side 176 extending between the front 170 and the rear 172. The front housing 144 includes a first end 178 and a second end 180 extending between the first side 174 and the second side 176 and extending between the front 170 and the rear 172. In an exemplary embodiment, the first end 178 may define a top of the front housing 144 and the second end 180 may define a bottom of the front housing 144. However, other orientations are possible in alternative embodiments.

The front housing 144 includes a cavity 182 defined between the sides 174, 176 and the ends 178, 180. The cavity 182 extends between the front 170 and the rear 172. The cavity 182 receives the contact module assembly 142. In an exemplary embodiment, the contact module assembly 142 is configured to extend from the cavity 182 rearward from the rear 172 of the front housing 144. However, in alternative embodiments, the contact module assembly 142 may be contained within the cavity 182. In an exemplary embodiment, the contact module assembly 142 is loaded into the cavity 182 of the front housing 144 through the rear 172. The front housing 144 is open at the front 170 to provide access to the contact module assembly 142. In an exemplary embodiment, the front housing 144 has a receptacle slot 184 at the front 170 for receiving the circuit card 116 (shown in FIG. 1) of the plug connector 104.

The mating ends 242, 342 of the signal contacts 214, 314 and the mating ends 252, 352 of the ground contacts 216, 316 extend forward of the dielectric frames 210, 310 into the front housing 144. The mating ends 242, 342, 252, 352 are positioned in the receptacle slot 184 for mating with the circuit card 116 (shown in FIG. 1). The mating ends 242, 252 are arranged in a first row and the mating ends 342, 352 are arranged in a second row on opposite sides of the receptacle slot 184 for mating with opposite sides of the circuit card 116.

Figure 9:
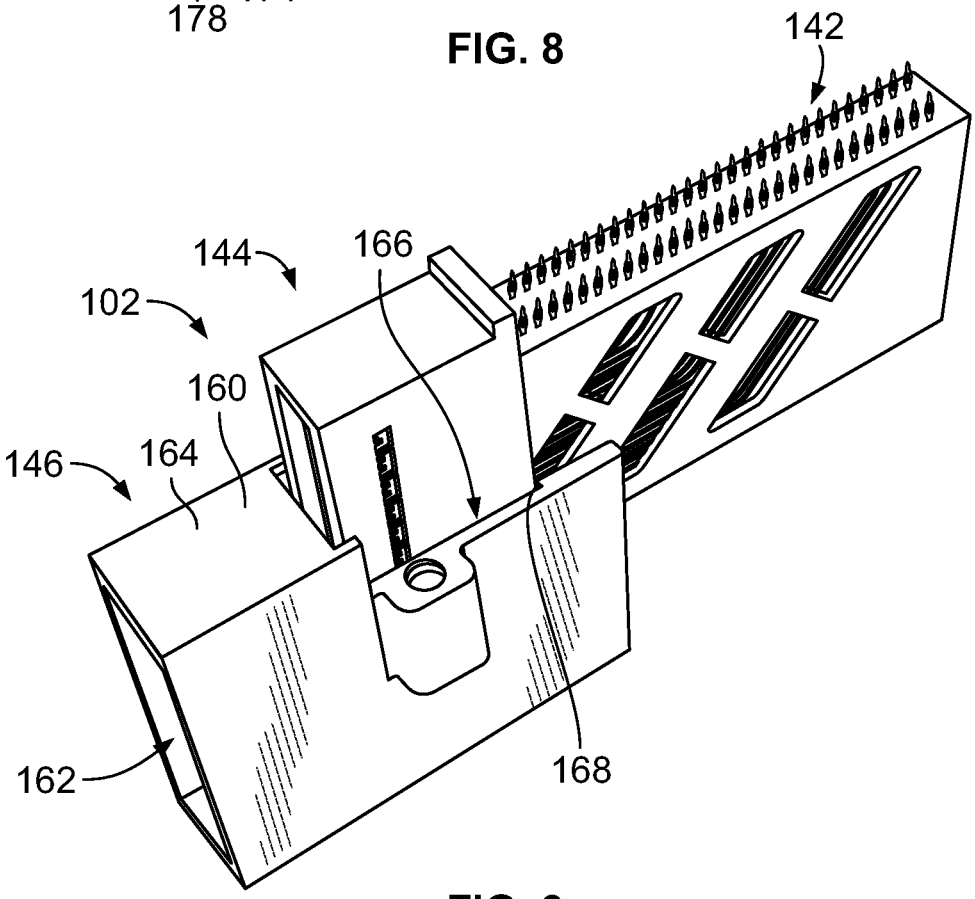
FIG. 9 is a bottom perspective view of the receptacle connector showing the front housing and the contact module assembly being loaded into an outer housing of the receptacle connector.

FIG. 9 is a bottom perspective view of the receptacle connector 102 showing the front housing 144 and the contact module assembly 142 being loaded into the outer housing 146. In an exemplary embodiment, the outer housing 146 includes a loading slot 166 open at the second end 160 of the outer housing 146. The loading slot 166 is located rearward of the hood 164. The loading slot 166 receives the front housing 144. In an exemplary embodiment, the loading slot 166 has a shoulder 168 at a rear of loading slot 166. The shoulder 168 defines a stop surface for the front housing 144 to guide the front housing 144 into the chamber 162. Once the front housing 144 and the contact module assembly 142 are loaded through the loading slot 166 in the loading direction into the chamber 162 to a loaded position, the front housing 144 and the contact module assembly 142 may be shifted forward to a mating position. For example, the front housing 144 may be loaded into the hood 164. The front housing 144 and the contact module assembly 142 are configured for mating with the plug connector 104 (shown in FIG. 1) in the mating position.

Figure 10:
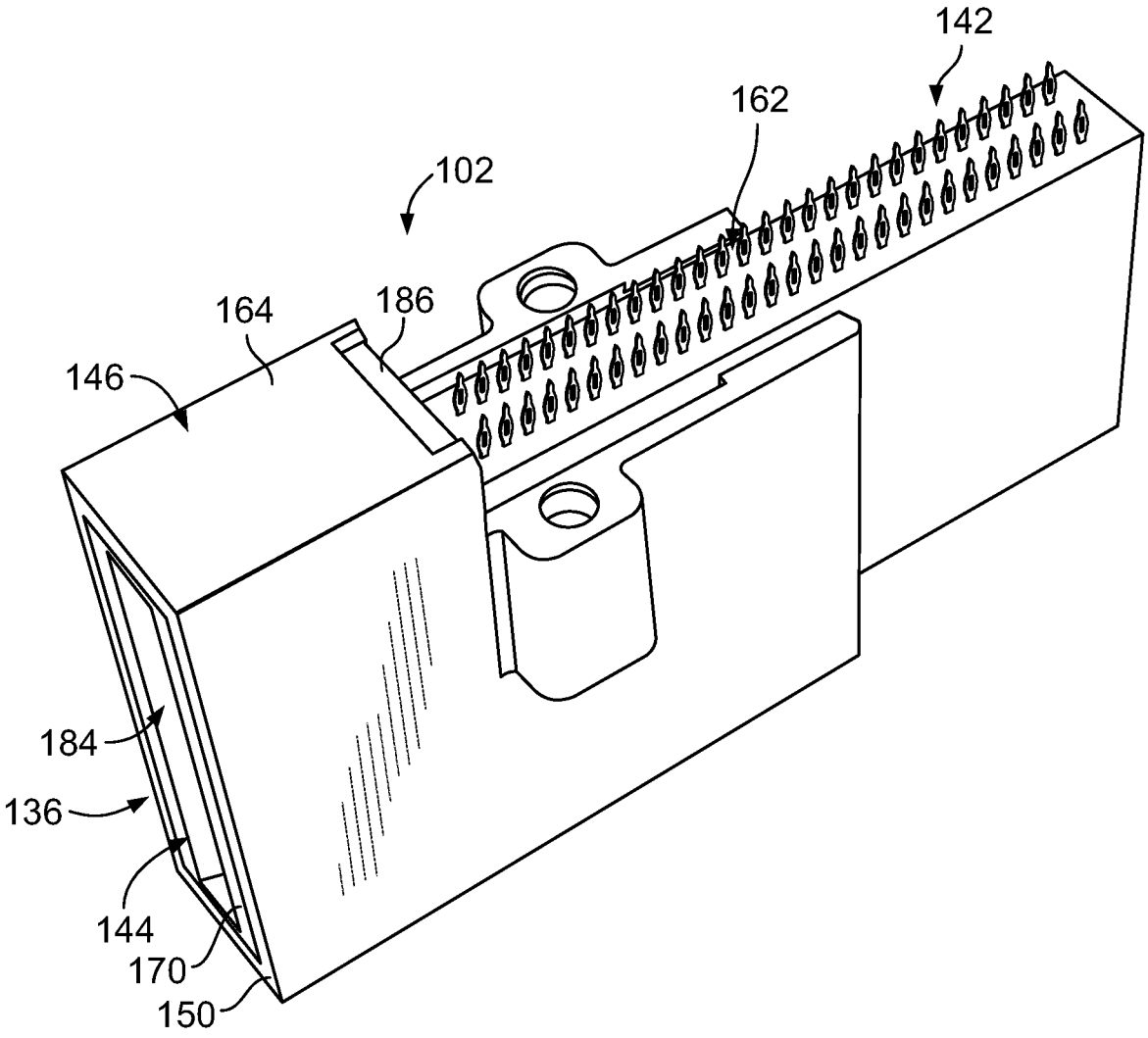
FIG. 10 is a bottom perspective view of the receptacle connector showing the front housing and the contact module assembly in the outer housing.

FIG. 10 is a bottom perspective view of the receptacle connector 102 showing the front housing 144 and the contact module assembly 142 in the mating position within the outer housing 146. The front housing 144 is located in the hood 164. In an exemplary embodiment, the front housing 144 includes a locating tab 186 at the second end 180. The locating tab 186 is configured to engage the outer housing 146 to locate the front housing 144 relative to the outer housing 146. For example, the locating tab 186 engages the hood 164 to position the front housing 144 in the outer housing 146. Optionally, in the mating position, the front 170 of the front housing 144 may be generally flush with the front 150 of the outer housing 146. The front housing 144 is located within the chamber 162 to receive the circuit card 116 of the plug connector 104 when the plug connector 104 is mated with the receptacle connector 102. For example, the receptacle slot 184 is accessible at the mating end 136 of the receptacle connector 102 to receive the circuit card 116.

Figure 11:
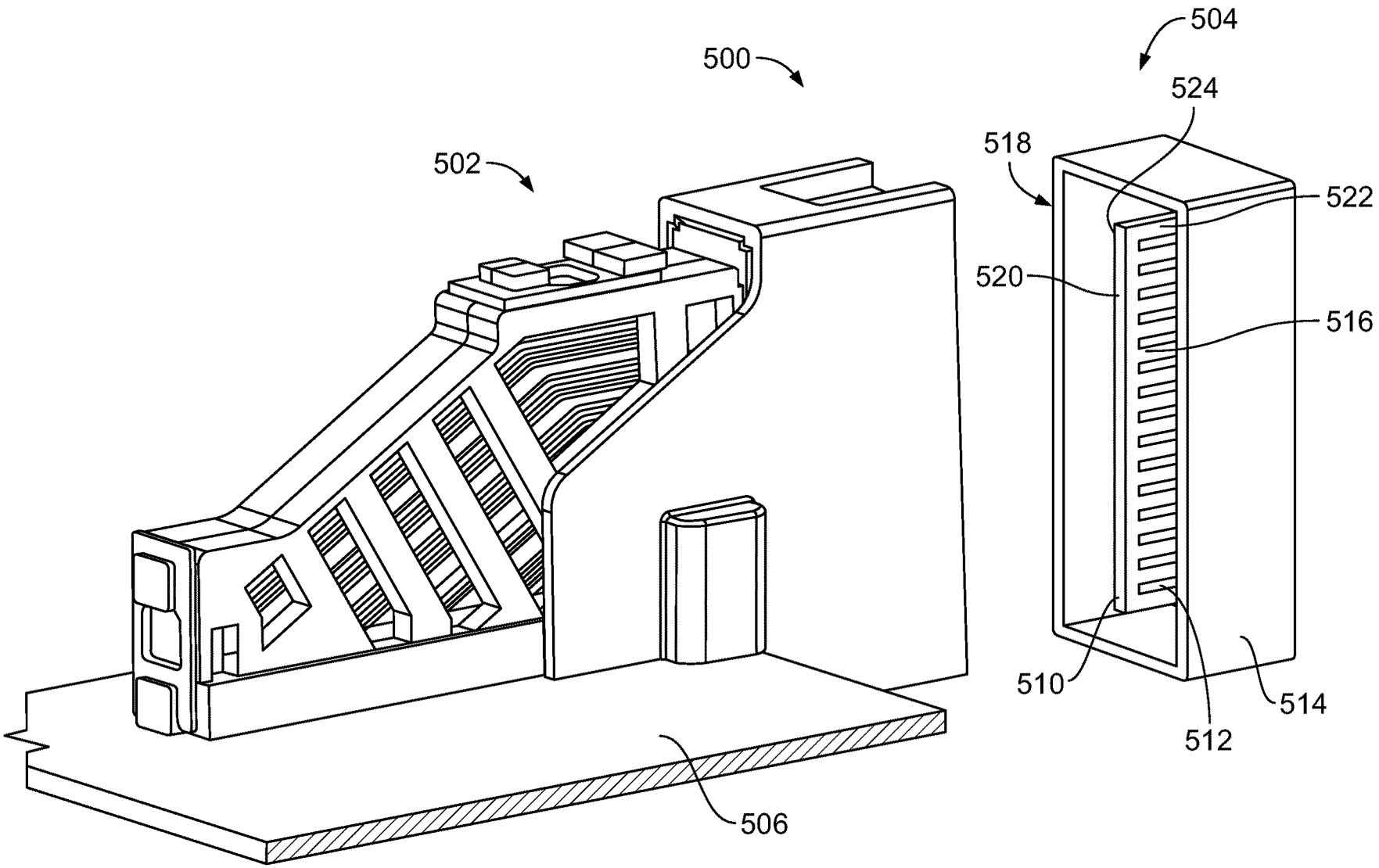
FIG. 11 is a perspective view of an electrical connector system in accordance with an exemplary embodiment.

FIG. 11 is a perspective view of an electrical connector system 500 in accordance with an exemplary embodiment. The electrical connector system 500 includes a receptacle connector 502 and a plug connector 504. The receptacle connector 502 may be similar to the receptacle connector 102 shown in FIG. 1. The plug connector 504 may be similar to the plug connector 104 shown in FIG. 1. In the illustrated embodiment, the receptacle connector 502 is mounted to a circuit board 506; however, the receptacle connector 502 may be provided at an end of a cable or cable bundle in an alternative embodiment.

The receptacle connector 502 is used to electrically connect the plug connector 504 and the circuit board 506. The receptacle connector 502 may transmit data signals and/or power between the plug connector 504 and the circuit board 506. In the illustrated embodiment, the receptacle connector 502 is an orthogonal connector having the mating interface of the receptacle connector 502 oriented orthogonal to the circuit board 506. For example, in the illustrated embodiment, the mating interface of the receptacle connector 502 is oriented vertically and the circuit board 506 is oriented horizontally. Other orientations are possible in alternative embodiments. In an exemplary embodiment, the receptacle connector 502 is a card edge connector having a receptacle slot configured to receive the plug connector 504. Other types of receptacle connectors 502 may be used in alternative embodiments.

The plug connector 504 includes a plug module 510 holding a plurality of plug contacts 512. In the illustrated embodiment, the plug module 510 includes a plug housing 514 holding a circuit card 516. The plug module 510 has a mating end 518 and the circuit card 516 is provided at the mating end 518. The circuit card 516 has an edge 520 extending between a first surface 522 and a second surface 524. The plug contacts 512 are provided on the circuit card 516 at or near the edge 520. In an exemplary embodiment, the plug contacts 512 are provided on the first surface 522 and the second surface 524. The plug contacts 512 may be circuits of the circuit card 516, such as including pads, traces, vias, and the like.

Figure 12:
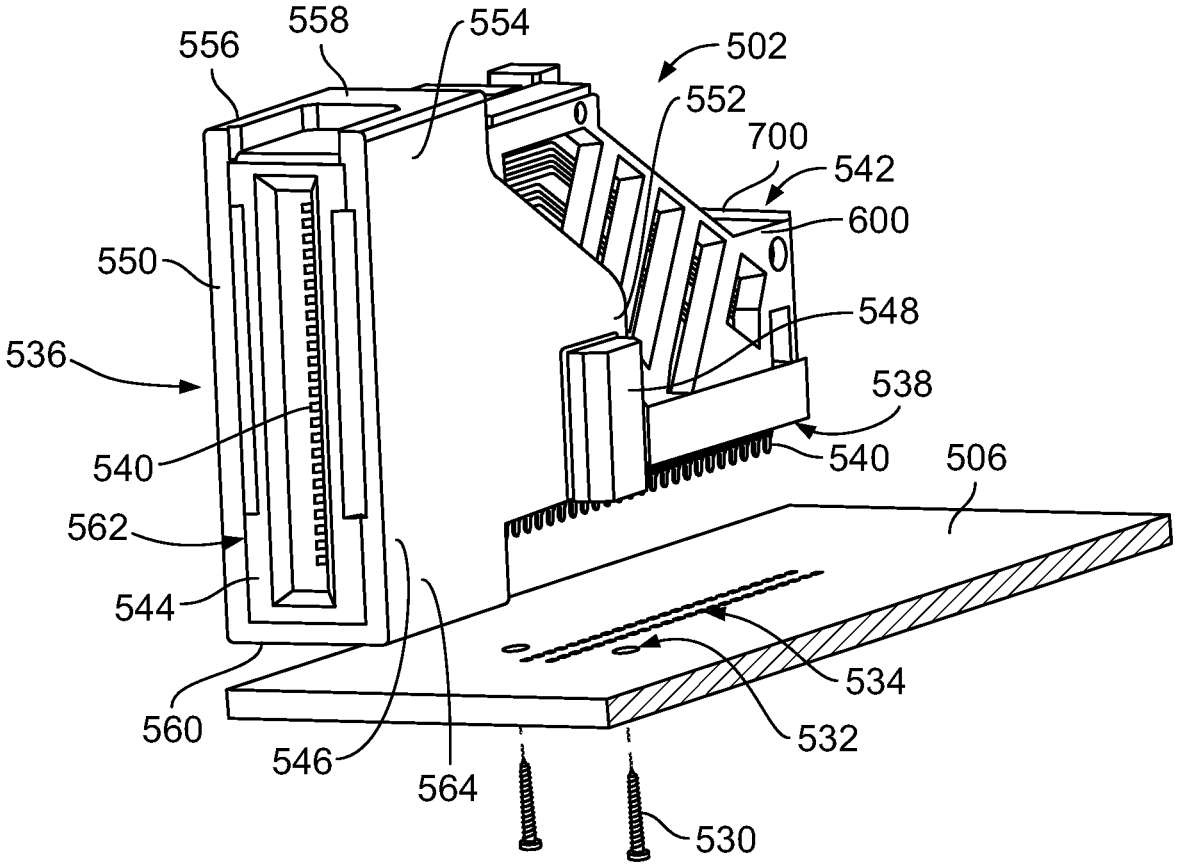
FIG. 12 is an exploded view of a receptacle connector of the electrical connector system in accordance with an exemplary embodiment.

FIG. 12 is an exploded view of the receptacle connector 502 in accordance with an exemplary embodiment. The receptacle connector 502 is configured to be mounted to the circuit board 506. In an exemplary embodiment, fasteners 530 are used to secure the receptacle connector 502 to the circuit board 506. The fasteners 530 may pass through openings 532 and the circuit board 506. The fasteners 530 may be threaded fasteners; however, other types of fasteners may be used to secure the receptacle connector 502 to the circuit board 506. In an exemplary embodiment, the circuit board 506 includes a plurality of vias 534 configured to be electrically connected to contacts 540 of the receptacle connector 502. For example, the contacts 540 may be press-fit into the vias 534. The contacts 540 may be soldered to the vias 534 in various embodiments. In alternative embodiments, the receptacle connector 502 may be surface mounted to the circuit board 506, such as at solder pads (not shown) on the surface of the circuit board 506.

The receptacle connector 502 extends between a mating end 536 and a mounting end 538. The contacts 540 extend between the mating end 536 and the mounting end 538 for mating with the plug connector 504 and mounted to the circuit board 506, respectively. In the illustrated embodiment, the mating end 536 is orthogonal to the mounting end 538. For example, the mating end 536 is provided at a front of the receptacle connector 502 and the mounting end 538 is provided at a bottom of the receptacle connector 502. However, other orientations are possible in alternative embodiments.

The receptacle connector 502 includes a contact module assembly 542, a front housing 544 received in the contact module assembly 542 and an outer housing 546 received in the front housing 544. The front housing 544 and the contact module assembly 542 are held in the outer housing 546 for mating with the plug connector 504 and the circuit board 506. In an exemplary embodiment, the outer housing 546 is secured to the circuit board 506 using the fasteners 530. For example, the outer housing 546 includes mounting lugs 548 that receive the fasteners 530. The mounting lugs 548 may have threaded openings in various embodiments.

In an exemplary embodiment, the outer housing 546 is manufactured from a conductive material, such as a metal material to provide electrical shielding for the receptacle connector 502. The outer housing 546 provides electrical shielding around the contacts 540. The outer housing 546 provides electrical shielding at the mating interface with the plug connector 504. In an exemplary embodiment, the outer housing 546 is a diecast housing. However, the outer housing 546 may be manufactured by other processes, such as molding, conductive plating of a dielectric housing, or attaching stamped and formed shields to a plastic housing.

The outer housing 546 extends between a front 550 and a rear 552. The outer housing 546 includes a first side 554 and a second side 556 extending between the front 550 and the rear 552. The outer housing 546 includes a first end 558 and a second end 560 extending between the first side 554 and the second side 556 and extending between the front 550 and the rear 552. In an exemplary embodiment, the first end 558 may define a top of the outer housing 546 and the second end 560 may define a bottom of the outer housing 546. However, other orientations are possible in alternative embodiments.

The outer housing 546 includes a chamber 562 defined between the sides 554, 556 and the ends 558, 560. The chamber 562 extends between the front 550 and the rear 552. The chamber 562 receives the front housing 544 and the contact module assembly 542. In an exemplary embodiment, the outer housing 546 includes a hood 564 at the front 550. The hood 564 is defined by the first side 554, the second side 556, the first end 558 and the second end 560. The hood 564 extends entirely circumferentially around the chamber 562. Optionally, the hood 564 may only extend a portion of the length of the outer housing 546 between the front 550 and the rear 552. For example, the second end 560 may be open rearward of the hood 564 in various embodiments.

In an exemplary embodiment, the contact module assembly 542 extends from the chamber 562 rearward from the rear 552 of the outer housing 546. However, in alternative embodiments, the contact module assembly 542 may be contained within the chamber 562. In an exemplary embodiment, the contacts 540 extend from the chamber 562 at the bottom for mounting to the circuit board 506. The contact module assembly 542 and the front housing 544 are loaded into the outer housing 546 through the bottom; however, the contact module assembly 542 and the front housing 544 may be loaded into the outer housing 546 in other directions, such as being rear loaded into the outer housing 546. The outer housing 546 is open at the front 550 to provide access to the front housing 544 and the contact module assembly 542. For example, the receptacle connector 502 may form a receptacle slot at the mating end 536 for receiving the circuit card 516 (shown in FIG. 11) of the plug connector 504.

The contact module assembly 542 includes a first contact module 600, a second contact module 700, and a ground bus insert 800 (FIGS. 17 and 18) configured to be positioned between the first contact module 600 and the second contact module 700. The ground bus insert 800 forms a grounding structure of the contact module assembly 542. When assembled, the first contact module 600, the ground bus insert 800, and the second contact module 700 are arranged in a stacked configuration. The ground bus insert 800 is sandwiched between the first contact module 600 and the second contact module 700. In an exemplary embodiment, the ground bus insert 800 is located within the first contact module 600 and located within the second contact module 700 such that the first and second contact modules 600, 700 surround or envelop the ground bus insert 800.

Figure 13:
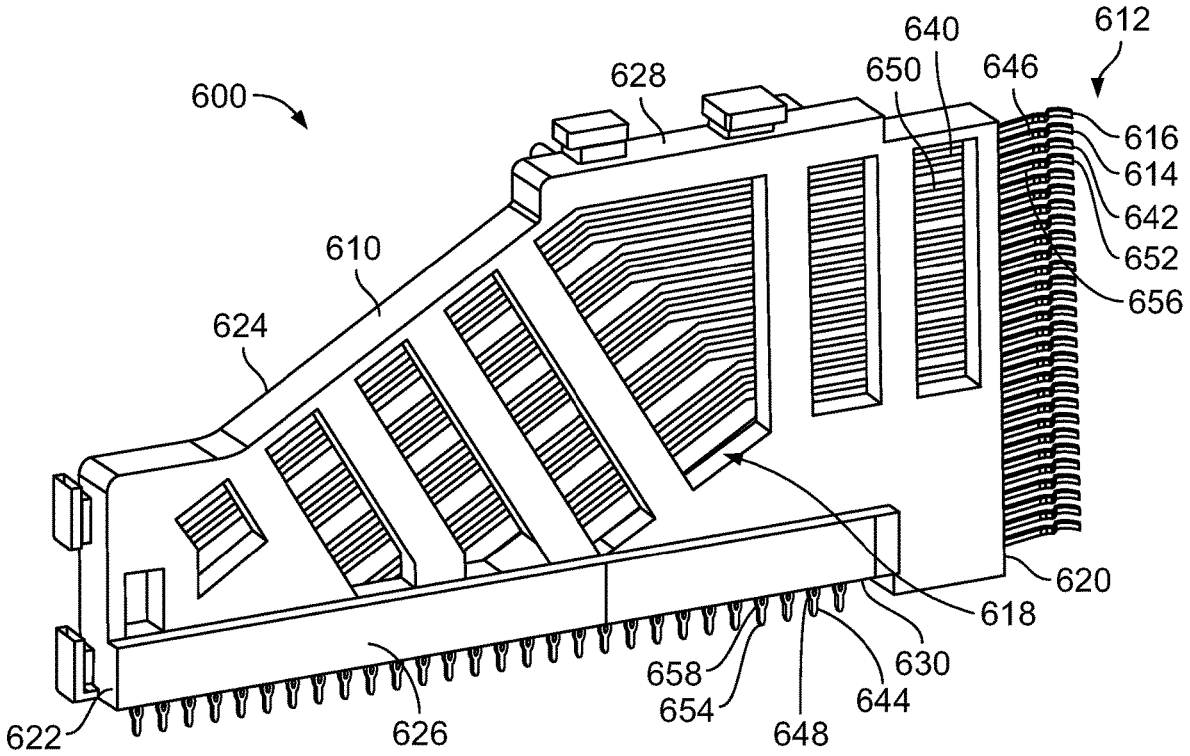
FIG. 13 is an exterior side view of a contact module of the receptacle connector in accordance with an exemplary embodiment.
Figure 14:
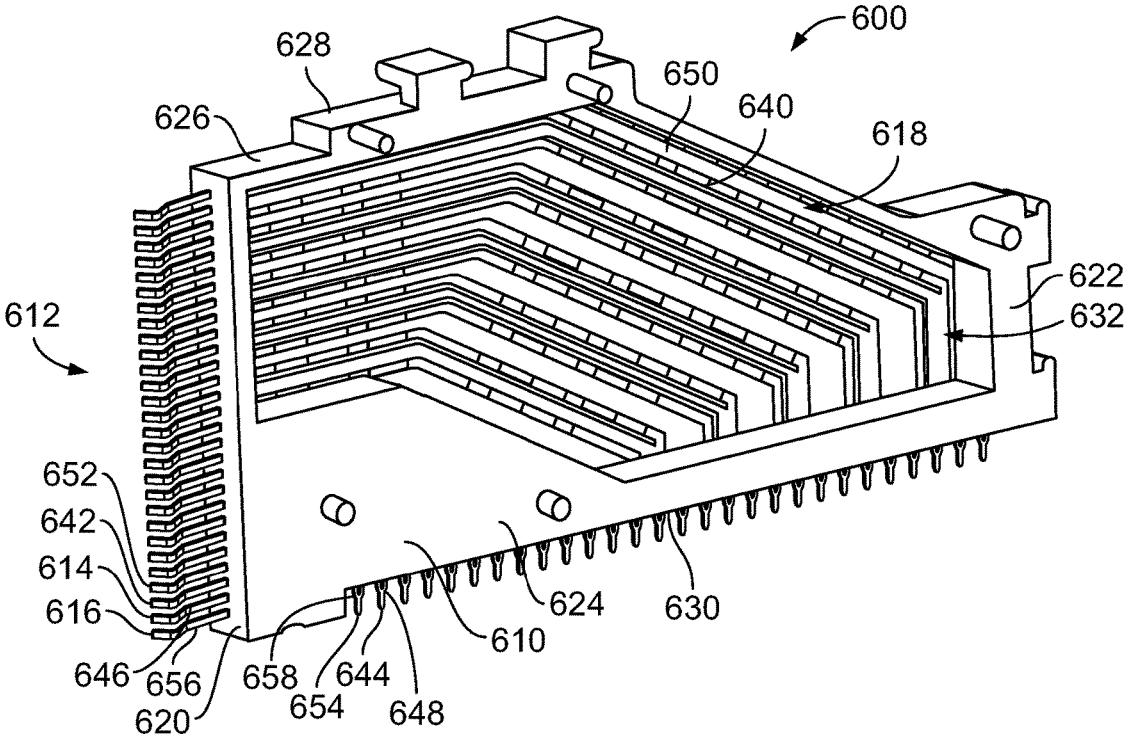
FIG. 14 is an interior side view of the contact module in accordance with an exemplary embodiment.

FIG. 13 is an exterior side view of the first contact module 600 in accordance with an exemplary embodiment. FIG. 14 is an interior side view of the first contact module 600 in accordance with an exemplary embodiment. The first contact module 600 includes a first dielectric frame 610 holding a first contact lead frame 612. The contact lead frame 612 includes first signal contacts 614 and first ground contacts 616. The signal contacts 614 and the ground contacts 616 are at least partially encased or enclosed in the dielectric frame 610. For example, the dielectric frame 610 may be overmolded around the signal contacts 614 and the ground contacts 616 to form an overmolded wafer. Portions of the signal contacts 614 and the ground contacts 616 are exposed through openings 618 in the dielectric frame 610. The openings 618 may be provided at the interior side and/or the exterior side of the dielectric frame 610. In various embodiments, the signal contacts 614 and the ground contacts 616 may be exposed to air for impedance control of the signals through the first contact module 600. The ground contacts 616 may be exposed through the dielectric frame 610 for interfacing with the ground bus insert 800. For example, the ground bus insert 800 (FIG. 17) may be electrically connected to corresponding ground contacts 616 for busing or commoning the ground contacts 616.

Figure 15:
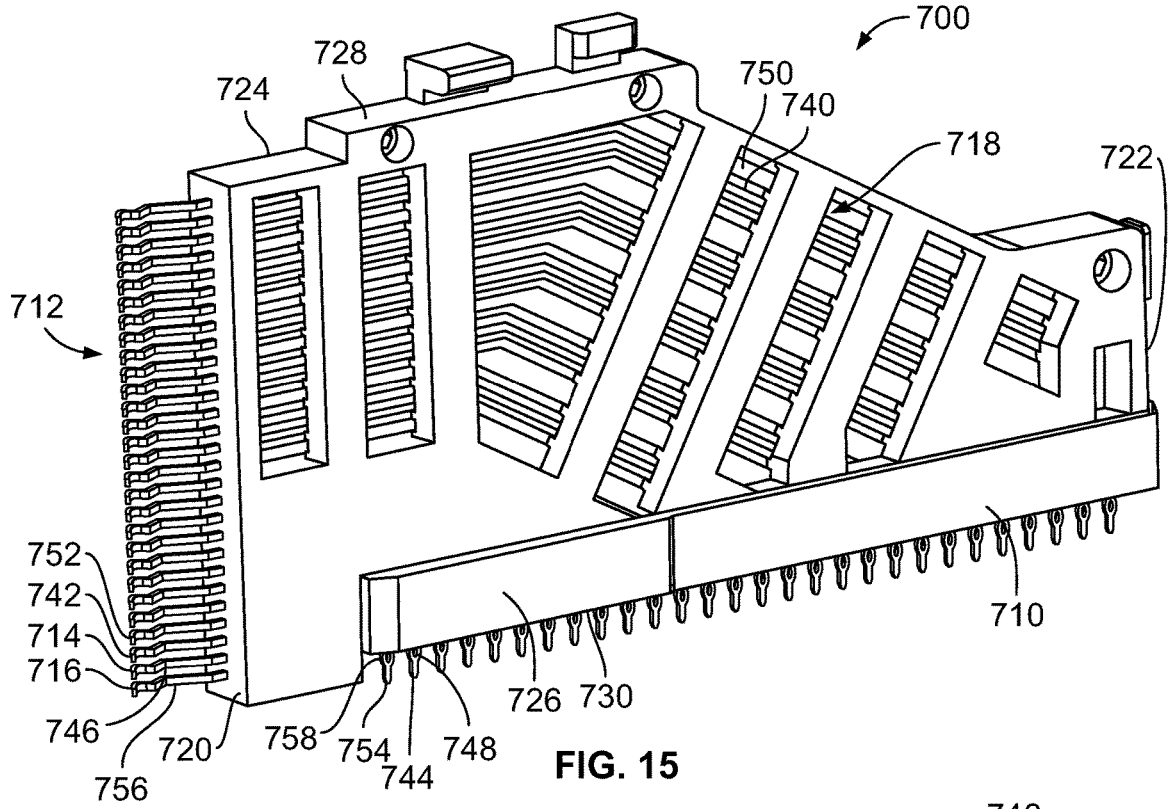
FIG. 15 is an exterior side view of a contact module of the receptacle connector in accordance with an exemplary embodiment.
Figure 16:
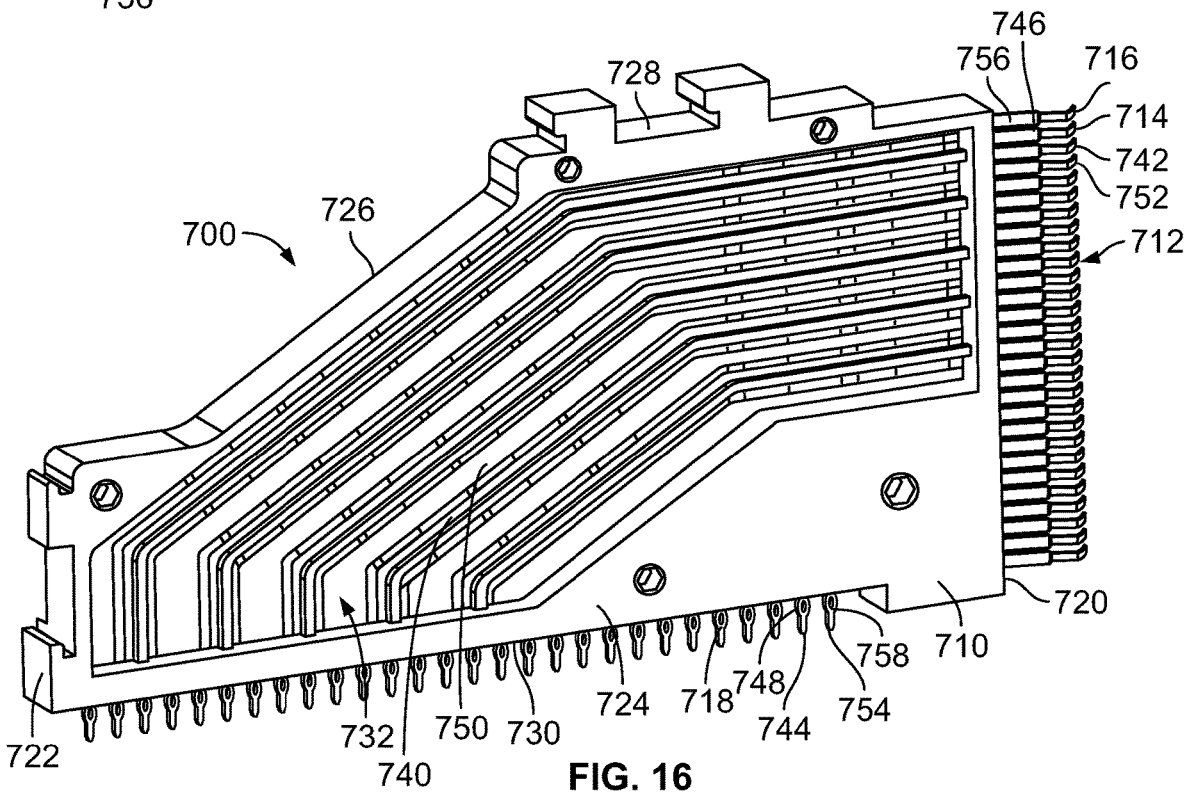
FIG. 16 is an interior side view of the contact module in accordance with an exemplary embodiment.

The dielectric frame 610 has a front 620 and a rear 622. The dielectric frame 610 has a first side 624 and a second side 626. The dielectric frame 610 has a first end 628 and a second end 630. Optionally, the first end 628 may define a top of the dielectric frame 610 and the second end 630 may define a bottom of the dielectric frame 610. The first side 624 defines an inner side configured to face the second contact module 700 (FIGS. 15 and 16). The second side 626 defines an outer side facing away from the second contact module 700. The ground bus insert 800 is coupled to the first side 624 of the dielectric frame 610. For example, the first side 624 includes a pocket or cavity 632 that receives a portion of the ground bus insert 800.

In an exemplary embodiment, the contact lead frame 612 is stamped and formed from a metal sheet to form the signal contacts 614 and the ground contacts 616. The ground contacts 616 may be interspersed between corresponding signal contacts 614. For example, the ground contacts 616 and the signal contacts 614 may be arranged in an alternating sequence. In other various embodiments, the signal contacts 614 may be arranged in pairs configured to convey differential signals and the ground contacts 616 may be arranged between the pairs of signal contacts 614. Other arrangements are possible in alternative embodiments.

The signal contacts 614 have transition portions 640 extending between mating ends 642 and mounting ends 644 of the signal contacts 614. The mating ends 642 extend forward from the front 620 of the dielectric frame 610 for mating with the plug connector 504 (shown in FIG. 11). For example, the mating ends 642 include spring beams 646 cantilevered forward from the front 620 of the dielectric frame 610. The spring beams 646 are deflectable and configured for mating with the circuit card 516 (shown in FIG. 11) of the plug connector 504. Optionally, the spring beams 646 may have curved mating interfaces at or near distal ends of the spring beams 646. The mounting ends 644 extend from the second end 630 of the dielectric frame 610, such as in a downward direction, for mounting to the circuit board 506. For example, the mounting ends 644 include compliant pins 648, such as eye-of-the-needle pins, configured to be press-fit into the vias 534 (shown in FIG. 12) of the circuit board 506. Other types of mounting ends may be provided in alternative embodiments.

The ground contacts 616 have transition portions 650 extending between mating ends 652 and mounting ends 654 of the ground contacts 616. The mating ends 652 extend forward from the front 620 of the dielectric frame 610 for mating with the plug connector 504 (shown in FIG. 11). For example, the mating ends 652 include spring beams 656 cantilevered forward from the front 620 of the dielectric frame 610. The spring beams 656 are deflectable and configured for mating with the circuit card 516 (shown in FIG. 11) of the plug connector 504. Optionally, the spring beams 656 may have curved mating interfaces at or near distal ends of the spring beams 656. The mounting ends 654 extend from the second end 630 of the dielectric frame 610, such as in a downward direction, for mounting to the circuit board 506. For example, the mounting ends 654 include compliant pins 658, such as eye-of-the-needle pins, configured to be press-fit into the vias 534 (shown in FIG. 12) of the circuit board 506. Other types of mounting ends may be provided in alternative embodiments.

FIG. 15 is an exterior side view of the second contact module 700 in accordance with an exemplary embodiment. FIG. 16 is an interior side view of the second contact module 700 in accordance with an exemplary embodiment. The second contact module 700 includes a second dielectric frame 710 holding a second contact lead frame 712. The contact lead frame 712 includes second signal contacts 714 and second ground contacts 716. The signal contacts 714 and the ground contacts 716 are at least partially encased or enclosed in the dielectric frame 710. For example, the dielectric frame 710 may be overmolded around the signal contacts 714 and the ground contacts 716 to form an overmolded wafer. Portions of the signal contacts 714 and the ground contacts 716 are exposed through openings 718 in the dielectric frame 710. For example, the signal contacts 714 and the ground contacts 716 may be exposed to air for impedance control of the signals through the second contact module 700. The ground contacts 716 may be exposed through the dielectric frame 710 for interfacing with the ground bus insert 800. For example, the ground bus insert 800 (FIG. 17) may be electrically connected to corresponding ground contacts 716 for busing or commoning the ground contacts 716.

The dielectric frame 710 has a front 720 and a rear 722. The dielectric frame 710 has a first side 724 and a second side 726. The dielectric frame 710 has a first end 728 and a second end 730. Optionally, the first end 728 may define a top of the dielectric frame 710 and the second end 730 may define a bottom of the dielectric frame 710. The first side 724 defines an inner side configured to face the first contact module 600. The second side 726 defines an outer side facing away from the first contact module 600. The ground bus insert 800 is coupled to the first side 724 of the dielectric frame 710. For example, the first side 724 includes a pocket or cavity 732 that receives a portion of the ground bus insert 800.

In an exemplary embodiment, the contact lead frame 712 is stamped and formed from a metal sheet to form the signal contacts 714 and the ground contacts 716. The ground contacts 716 may be interspersed between corresponding signal contacts 714. For example, the ground contacts 716 and the signal contacts 714 may be arranged in an alternating sequence. In other various embodiments, the signal contacts 714 may be arranged in pairs configured to convey differential signals and the ground contacts 716 may be arranged between the pairs of signal contacts 714. Other arrangements are possible in alternative embodiments.

The signal contacts 714 have transition portions 740 extending between mating ends 742 and mounting ends 744 of the signal contacts 714. The mating ends 742 extend forward from the front 720 of the dielectric frame 710 for mating with the plug connector 504 (shown in FIG. 11). For example, the mating ends 742 include spring beams 746 cantilevered forward from the front 720 of the dielectric frame 710. The spring beams 746 are deflectable and configured for mating with the circuit card 516 (shown in FIG. 11) of the plug connector 504. Optionally, the spring beams 746 may have curved mating interfaces at or near distal ends of the spring beams 746. The mounting ends 744 extend from the first end 728 of the dielectric frame 710, such as in a downward direction, for mounting to the circuit board 506. For example, the mounting ends 744 include compliant pins 748, such as eye-of-the-needle pins, configured to be press-fit into the vias 534 (shown in FIG. 12) of the circuit board 506. Other types of mounting ends may be provided in alternative embodiments.

The ground contacts 716 have transition portions 750 extending between mating ends 752 and mounting ends 754 of the ground contacts 716. The mating ends 752 extend forward from the front 720 of the dielectric frame 710 for mating with the plug connector 504. For example, the mating ends 752 include spring beams 756 cantilevered forward from the front 720 of the dielectric frame 710. The spring beams 756 are deflectable and configured for mating with the circuit card 516 of the plug connector 504. Optionally, the spring beams 756 may have curved mating interfaces at or near distal ends of the spring beams 756. The mounting ends 754 extend from the second end 730 of the dielectric frame 710, such as in a downward direction, for mounting to the circuit board 506. For example, the mounting ends 754 include compliant pins 758, such as eye-of-the-needle pins, configured to be press-fit into the vias 534 of the circuit board 506. Other types of mounting ends may be provided in alternative embodiments.

Figure 17:
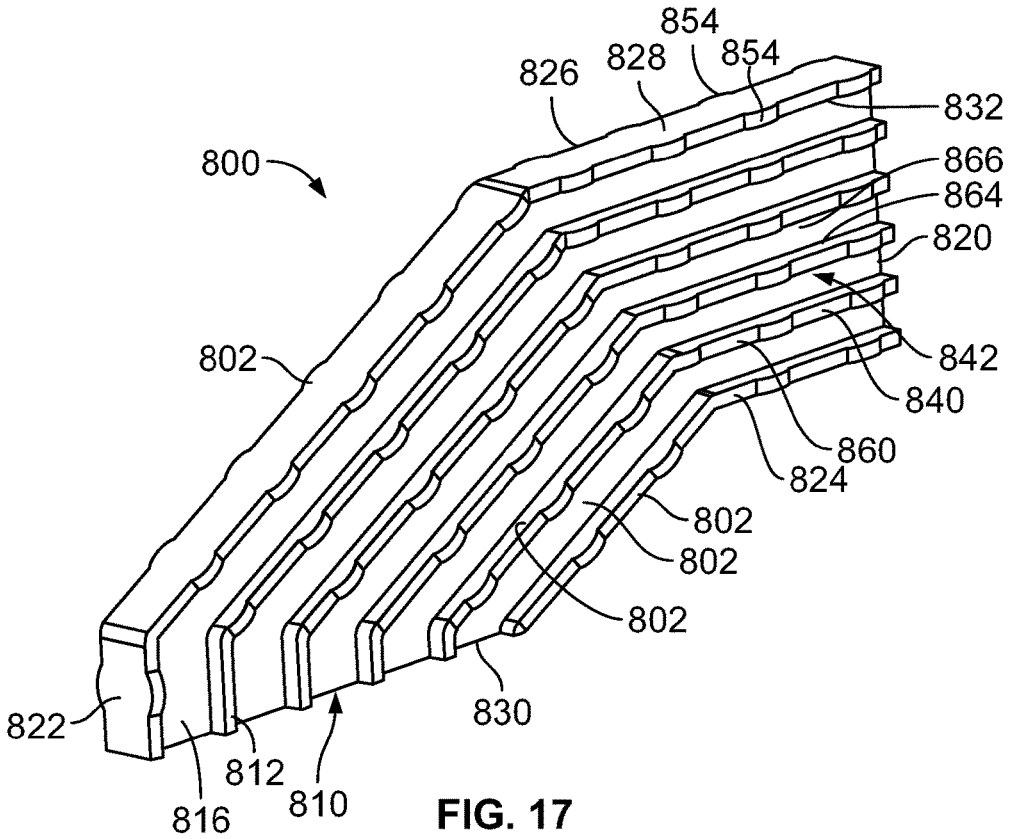
FIG. 17 is a perspective view of a ground bus insert for the contact module in accordance with an exemplary embodiment.
Figure 18:
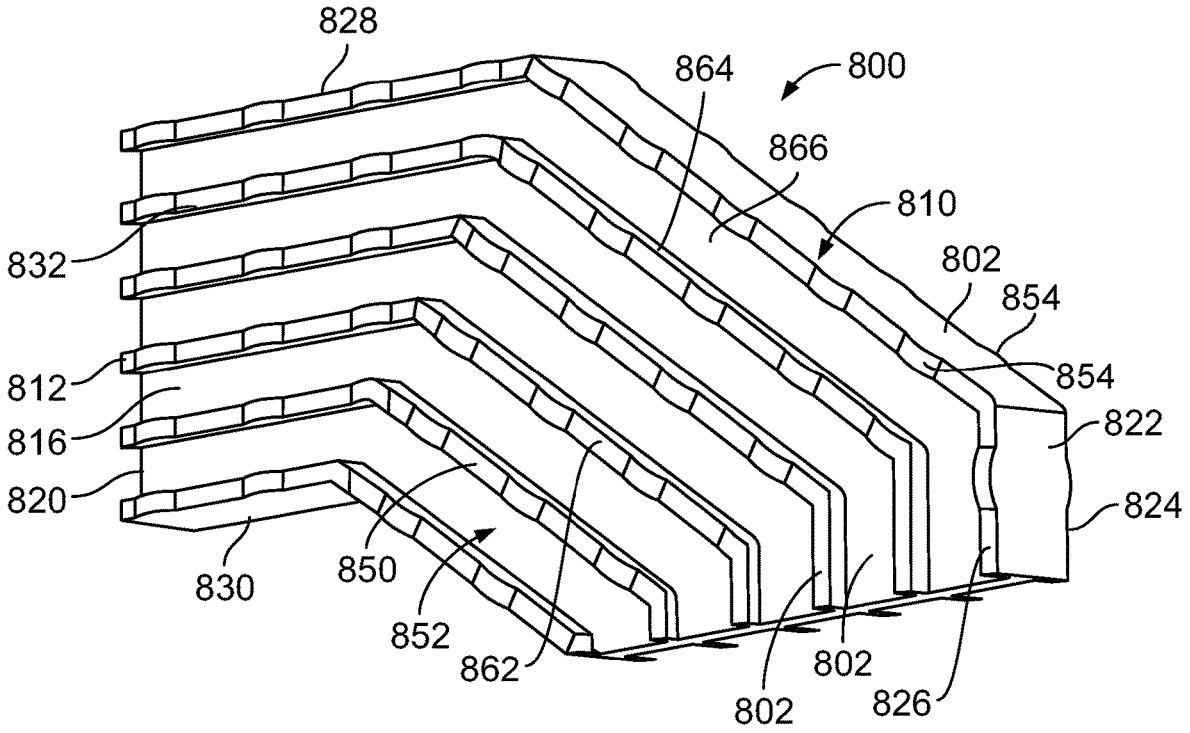
FIG. 18 is another perspective view of a ground bus insert in accordance with an exemplary embodiment.

FIG. 17 is a perspective view of the ground bus insert 800 in accordance with an exemplary embodiment. FIG. 18 is another perspective view of the ground bus insert 800 in accordance with an exemplary embodiment. The ground bus insert 800 includes ground conductors 802 electrically connected together. The ground conductors 802 are configured to be electrically connected to the first ground contacts 616 (FIGS. 13 and 14) and the second ground contacts 716 (FIGS. 15 and 16). The ground conductors 802 electrically bus or common the first ground contacts 616 and the second ground contacts 716.

In an exemplary embodiment, the ground bus insert 800 includes an insert frame 810 having a plurality of frame members 812. In various embodiments, the frame members 812 may include openings (not shown). In other various embodiments, the frame members 812 do not include openings. The frame members 812 are connected by joining walls 816. In an exemplary embodiment, the insert frame 410 is manufactured from a dielectric material, such as a plastic material. The insert frame 410 may be molded, such as by injection molding. The insert frame 410 forms a substrate or support structure for the ground conductors 402. In an exemplary embodiment, the ground conductors 802 are provided on the frame members 812 and may be provided on the joining walls 816. For example, the ground conductors 802 may be plated on the frame members 812. The ground conductors 802 may be formed by laser direct structuring the ground conductors 802 in position on the frame members 812. The ground conductors 802 may be electroplated. The ground conductors 802 may be applied by other processes in alternative embodiments, such as coating, dipping, spraying, and the like.

The insert frame 810 extends between a front 820 and a rear 822. The insert frame 810 includes a first side 824 (FIG. 17) and a second side 826 (FIG. 18). The insert frame 810 includes a first end 828 and a second end 830. Optionally, the first end 828 may be a top end and the second end 830 may be a bottom end. However, other orientations are possible in alternative embodiments. The insert frame 810 includes end walls 832 extending between the first and second sides 824, 826. The end walls 832 may be upper end walls generally facing in an upward direction or lower end walls generally facing in a downward direction.

The insert frame 810 includes first tabs 840 extending between the joining walls 816 and the first side 824. First pockets 842 are defined between the corresponding tabs 840 and extend between the first side 824 and the joining walls 816. In an exemplary embodiment, the first tabs 840 are configured to be received in the first dielectric frame 610 (FIG. 14). The insert frame 810 includes second tabs 850 extending between the joining walls 816 and the second side 826. Second pockets 852 are defined between the corresponding tabs 850 and extend between the second side 826 and the joining walls 816. In an exemplary embodiment, the second tabs 850 are configured to be received in the second dielectric frame 710 (FIG. 16). Optionally, the insert frame 810 may include protrusions or interference bumps along the first tabs 840 and/or the second tabs 850 for interfacing with corresponding ground contacts of the first and second leadframes.

The ground conductors 802 are provided on an exterior of the frame members 812. For example, the ground conductors 802 may be attached to or applied directly to exterior surfaces of the frame members 812. The ground conductors 802 may be applied to the first tabs 840 and/or the second tabs 850 and/or the end walls 832 and/or the joining walls 816. In an exemplary embodiment, the ground conductors 802 are provided on the first tabs 840 at the first side 824 to form first side rails 860 configured to electrically connect with corresponding first ground contacts 616 of the first contact module 600. For example, the first side rails 860 may directly engage corresponding first ground contacts 616. In an exemplary embodiment, the ground conductors 802 are provided on the second tabs 850 at the second side 826 to form second side rails 862 configured to electrically connect with corresponding second ground contacts 716 of the second contact module 700. For example, the second side rails 862 may directly engage corresponding second ground contacts 716.

In an exemplary embodiment, the ground conductors 802 include connecting rails 864 provided on the corresponding end walls 832 between the first side rails 860 and the second side rails 862. The connecting rails 864 electrically connect the first and second side rails 860, 862. As such, the first and second side rails 860, 862 are electrically commoned or bussed by the connecting rails 864. In an exemplary embodiment, the ground conductors 802 include connecting rails 866 provided on corresponding joining walls 816 between corresponding end walls 832. The connecting rails 866 electrically connect the connecting rails 864. The connecting rails 864 provide horizontal electrical connection and the connecting rails 866 provide vertical electrical connection.

Figure 19:
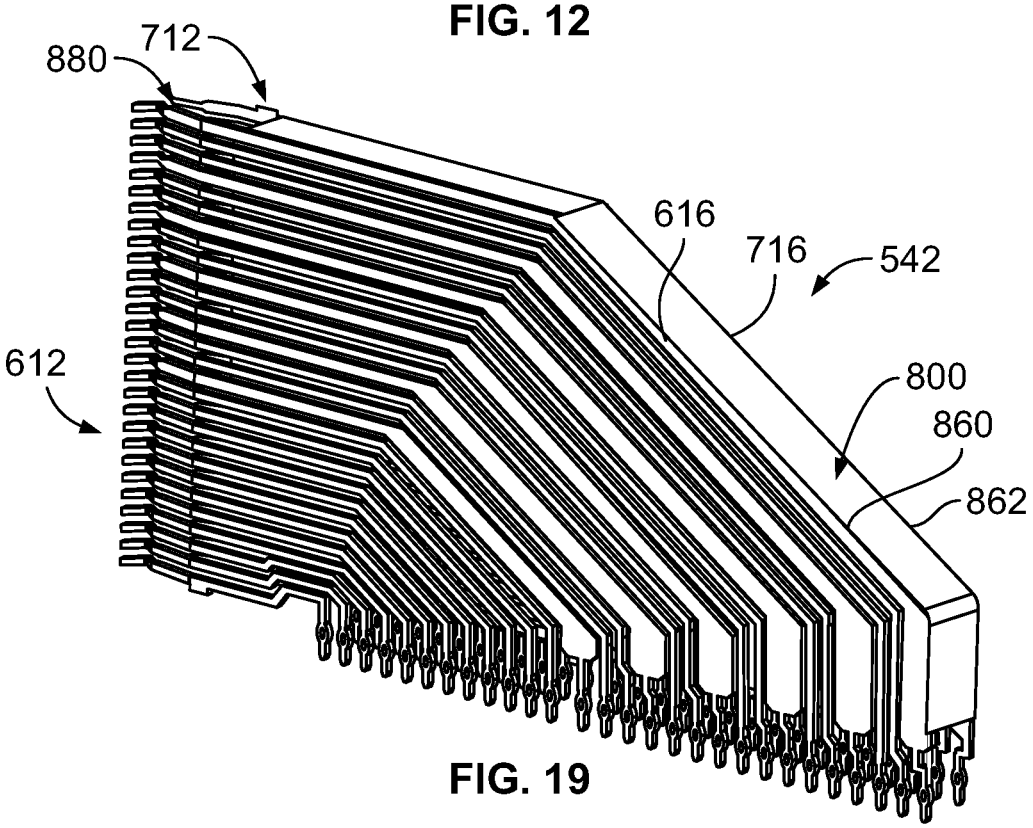
FIG. 19 is a perspective view of a portion of the contact module in accordance with an exemplary embodiment.

FIG. 19 is a perspective view of a portion of the contact module assembly 542 illustrating the ground bus insert 800 between the first contact lead frame 612 and the second contact lead frame 712. The first dielectric frame 610 (shown in FIGS. 13 and 14) and the second dielectric frame 710 (shown in FIGS. 15 and 16) are removed for clarity to illustrate the contact lead frames 612, 712 relative to the ground bus insert 800. When assembled, the side rails 860, 862 are configured to be electrically connected to the ground contacts 616, 716, respectively. The ground bus insert 800 is sandwiched between the contact lead frames 612, 712 to electrically connect the ground contacts 616, 716. The first and second contact lead frames 612, 712 are separated by a gap 880 with the contacts arranged in first and second rows on opposite sides of the gap 880. The ground bus insert 800 is received in the gap 880. The circuit card 516 (shown in FIG. 11) is configured to be received in the gap 880.

Figure 20:
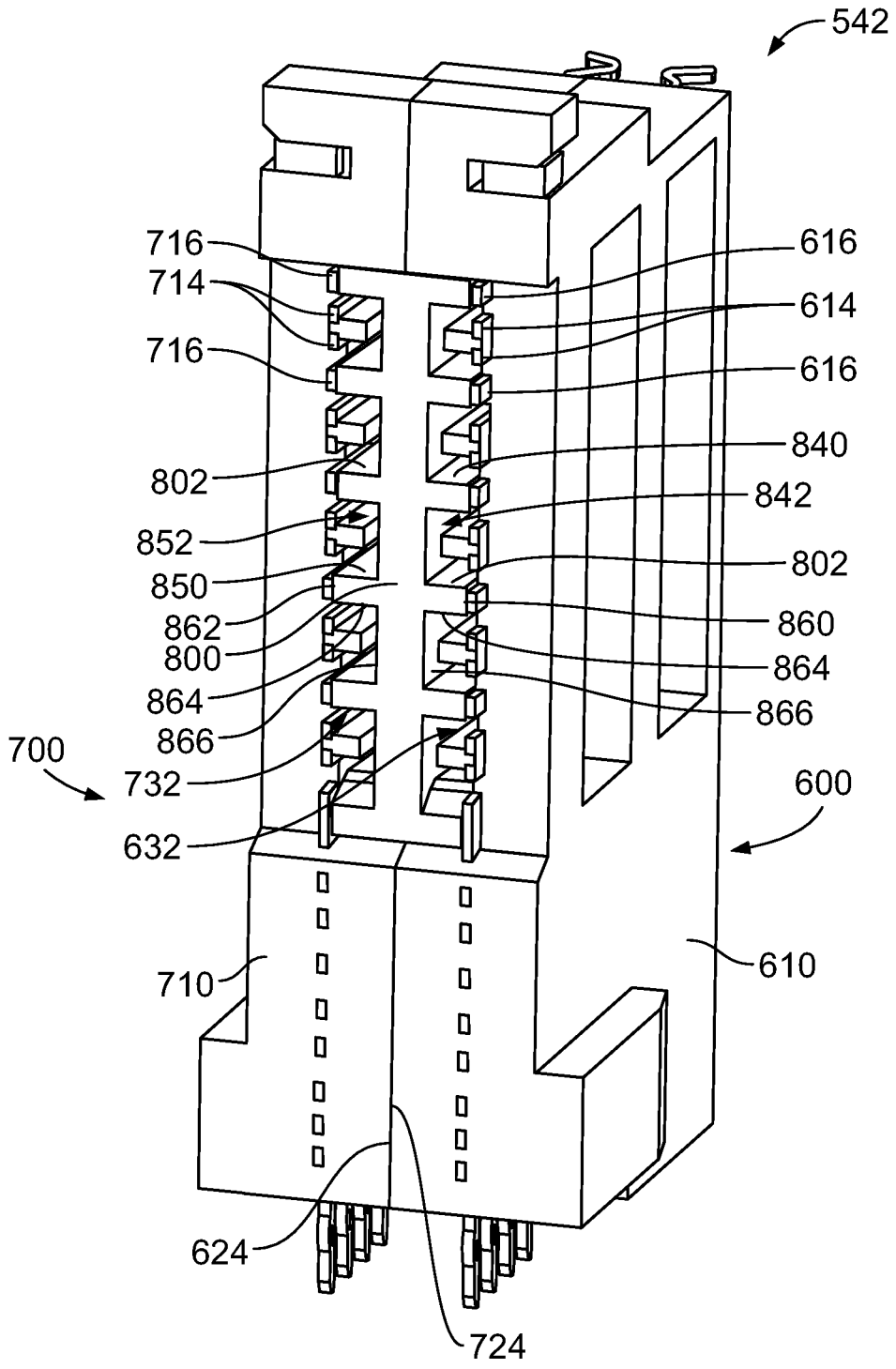
FIG. 20 is a cross-sectional view of the contact module in accordance with an exemplary embodiment.

FIG. 20 is a cross-sectional view of the contact module assembly 542 in accordance with an exemplary embodiment. The ground bus insert 800 is received in the cavities 632, 732 at the inner sides 624, 724 of the dielectric frames 610, 710. The inner sides 624, 724 of the dielectric frames 610, 710 abut against each other such that a portion of the ground bus insert 800 is received in the first contact module 600 and another portion of the ground bus insert 800 is received in the second contact module 700. The ground conductors 802 are used to electrically connect the first and second ground contacts 616, 716. For example, the connecting rails 864, 866 electrically connect the first and second side rails 860, 862.

When assembled, the first tabs 840 are aligned with the first ground contacts 616. As such, the first side rails 860 on the first tabs 840 are configured to be electrically connected to the first ground contacts 616. In an exemplary embodiment, the first side rails 860 directly engage the first ground contacts 616. The first pockets 842 are aligned with the first signal contacts 614. As such, the first signal contacts 614 are electrically isolated from the ground conductors 802. When assembled, the second tabs 850 are aligned with the second ground contacts 716. As such, the second side rails 862 on the second tabs 850 are configured to be electrically connected to the second ground contacts 716. In an exemplary embodiment, the second side rails 860 to directly engage the second ground contacts 716. The second pockets 852 are aligned with the second signal contacts 714. As such, the second signal contacts 714 are electrically isolated from the ground conductors 802.

Figure 21:
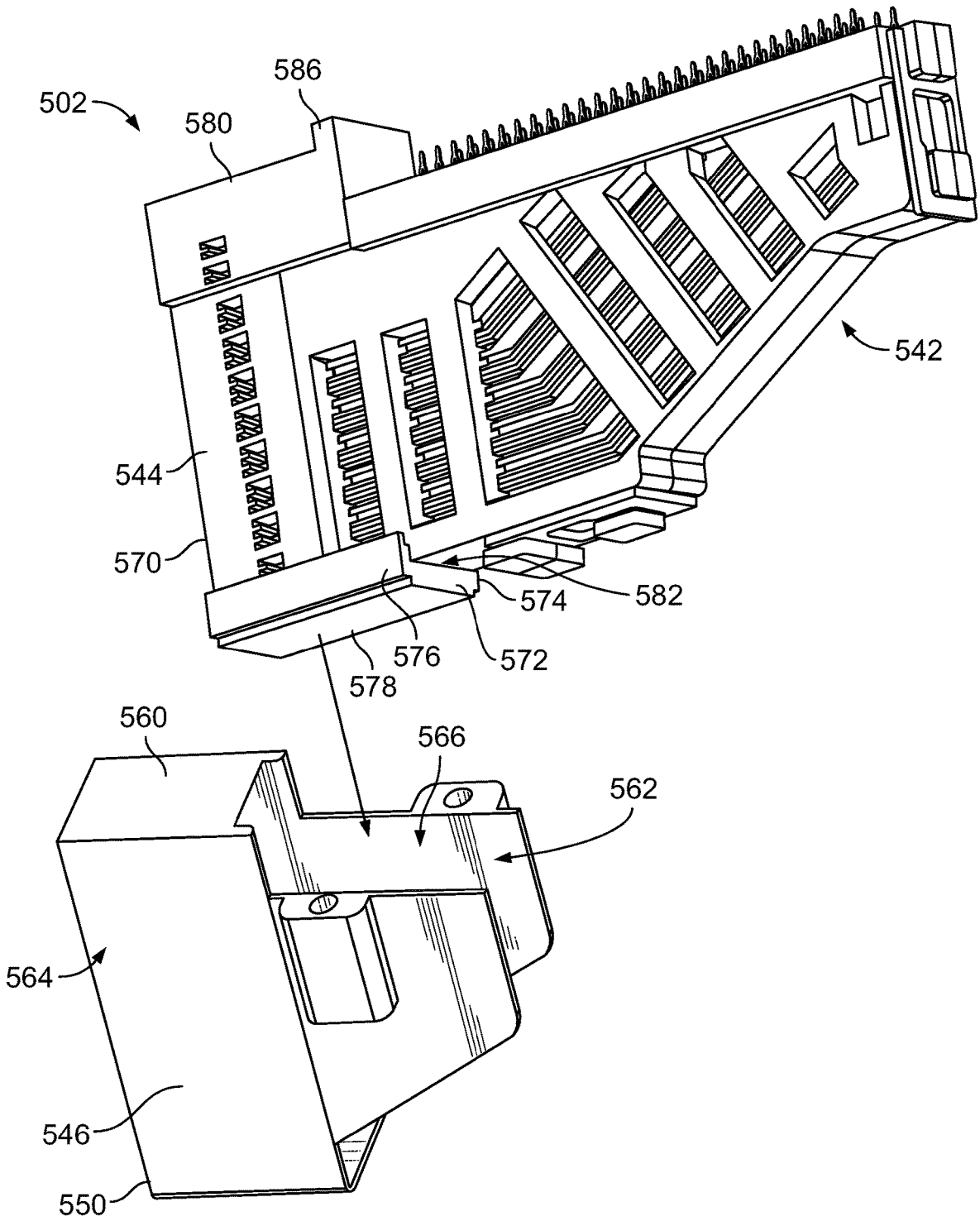
FIG. 21 is a bottom perspective view of a portion of the receptacle connector in accordance with an exemplary embodiment.

FIG. 21 is a bottom perspective view of a portion of the receptacle connector 502 illustrating the contact module assembly 542 coupled to the front housing 544 and poised for loading into the outer housing 546. The front housing 544 extends between a front 570 and a rear 572. The front housing 544 includes a first side 574 and a second side 576 extending between the front 570 and the rear 572. The front housing 544 includes a first end 578 and a second end 580 extending between the first side 574 and the second side 576 and extending between the front 570 and the rear 572. In an exemplary embodiment, the first end 578 may define a top of the front housing 544 and the second end 580 may define a bottom of the front housing 544. However, other orientations are possible in alternative embodiments.

The front housing 544 includes a cavity 582 defined between the sides 574, 576 and the ends 578, 580. The cavity 582 extends between the front 570 and the rear 572. The cavity 582 receives the contact module assembly 542. In an exemplary embodiment, the contact module assembly 542 is configured to extend from the cavity 582 rearward from the rear 572 of the front housing 544. However, in alternative embodiments, the contact module assembly 542 may be contained within the cavity 582. In an exemplary embodiment, the contact module assembly 542 is loaded into the cavity 582 of the front housing 544 through the rear 572. The front housing 544 is open at the front 570 to provide access to the contact module assembly 542. In various embodiments, the front housing 544 has a receptacle slot (not shown) at the front 570 for receiving the circuit card 516 (shown in FIG. 11) of the plug connector 504.

In an exemplary embodiment, the outer housing 546 includes a loading slot 566 open at the second end 560 of the outer housing 546. The loading slot 566 is located rearward of the hood 564. The loading slot 566 receives the front housing 544. Once the front housing 544 and the contact module assembly 542 are loaded through the loading slot 566 in the loading direction into the chamber 562 to a loaded position, the front housing 544 and the contact module assembly 542 may be shifted forward to a mating position. For example, the front housing 544 may be loaded into the hood 564. The front housing 544 and the contact module assembly 542 are configured for mating with the plug connector 504 (shown in FIG. 5) in the mating position.

In an exemplary embodiment, the front housing 544 includes a locating tab 586 at the second end 580. The locating tab 586 is configured to engage the outer housing 546 to locate the front housing 544 relative to the outer housing 546. For example, the locating tab 586 engages the hood 564 to position the front housing 544 in the outer housing 546. Optionally, in the mating position, the front 570 of the front housing 544 may be generally flush with the front 550 of the outer housing 546. The front housing 544 is located within the chamber 562 to receive the circuit card 516 of the plug connector 504 when the plug connector 504 is mated with the receptacle connector 502.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A receptacle connector comprising:

a contact module assembly including a first contact module, a second contact module, and a ground bus insert, the first contact module including a first dielectric frame holding a first contact leadframe including first signal contacts and first ground contacts, the second contact module including a second dielectric frame holding a second contact leadframe including second signal contacts and second ground contacts, the first and second contact modules being stacked side by side with the ground bus insert between the first and second contact modules, the ground bus insert includes ground conductors electrically connected together, the ground conductors including first side rails and second side rails, the first side rails being electrically connected to corresponding first ground contacts, the second side rails being electrically connected to corresponding second ground contacts; and a front housing having a cavity receiving the contact module assembly, the front housing having a receptacle slot at a front of the front housing configured to receive a plug connector, the first and second signal contacts and the first and second ground contacts being received in the receptacle slot to mate with the plug connector.

2. The receptacle connector of claim 1, wherein the ground bus insert is separate and discrete from the first and second contact modules.

3. The receptacle connector of claim 1, wherein the ground bus insert includes a first side received in the first dielectric frame and a second side received in the second dielectric frame.

4. The receptacle connector of claim 1, wherein the ground bus insert includes an insert frame, the insert frame being dielectric and having the ground conductors on the insert frame.

5. The receptacle connector of claim 1, wherein the ground bus insert includes an insert frame, the insert frame having frame members, each frame member having a first side, a second side, and an end wall between the first and second sides, the first side rail being provided on the first side of the corresponding frame member, the second side rail being provided on the second side of the corresponding frame member, the ground conductors including connecting rails provided on the end wall of the corresponding frame members, the connecting rails electrically connecting the first and second side rails.

6. The receptacle connector of claim 1, wherein the ground conductors are plated on a dielectric insert frame of the ground bus insert.

7. The receptacle connector of claim 1, wherein the ground bus insert includes a dielectric insert frame, the insert frame having first tabs extending into the first dielectric frame and second tabs extending into the second dielectric frame, the first side rails provided on the first tabs, the second side rails provided on the second tabs.

8. The receptacle connector of claim 7, wherein the insert frame includes first pockets between the first tabs and second pockets between the second tabs, the first tabs being aligned with the first ground contacts, the first pockets being aligned with the first signal contacts, the second tabs being aligned with the second ground contacts, the second pockets being aligned with the second signal contacts.

9. The receptacle connector of claim 1, further comprising an outer housing having a chamber receiving the front housing, the outer housing being conductive and providing electrical shielding around the chamber.

10. The receptacle connector of claim 9, wherein the outer housing includes a hood at a front of the outer housing, the outer housing including a loading slot open at a bottom of the outer housing, the loading slot be located rearward of the hood, the front housing being loaded into the chamber through the loading slot and being shifted forward into the hood for mating with the plug connector.

11. The receptacle connector of claim 9, wherein the outer housing includes a loading slot open at a bottom of the outer housing, the front housing being loaded into the chamber through the loading slot to a loaded position, the front housing being moved forward from the loaded position to a mating position forward of the loaded position for mating with the plug connector.

12. A receptacle connector comprising:

a contact module assembly including a first contact module, a second contact module, and a ground bus insert between the first contact module and the second contact module, the first contact module including a first dielectric frame holding a first contact leadframe, the first contact leadframe having first signal contacts and first ground contacts, the first signal contacts having mating ends and mounting ends, the first ground contacts having mating ends and mounting ends, the mating ends of the first signal contacts configured for mating with mating contacts of a plug connector, the mounting ends of the first signal contacts configured for mounting to a circuit board, the second contact module including a second dielectric frame holding a second contact leadframe, the second contact leadframe having second signal contacts and second ground contacts, the second signal contacts having mating ends and mounting ends, the second ground contacts having mating ends and mounting ends, the mating ends of the second signal contacts configured for mating with mating contacts of the plug connector, the mounting ends of the second signal contacts configured for mounting to the circuit board, the first and second contact modules being stacked side by side with the mating ends of the first and second signal contacts extending forward from the first and second dielectric frames in a first row and a second row on opposite sides of a gap configured to receive the plug connector, the ground bus insert includes ground conductors electrically connected together, the ground conductors including first side rails and second side rails, the first side rails being electrically connected to corresponding first ground contacts, the second side rails being electrically connected to corresponding second ground contacts;

a front housing having a cavity receiving the contact module assembly, the front housing having a receptacle slot at a front of the front housing configured to receive the plug connector, the mating ends of the first and second signal contacts being received in the receptacle slot to mate with the plug connector; and an outer housing having a chamber receiving the front housing, the outer housing being conductive and providing electrical shielding around the chamber.

13. The receptacle connector of claim 12, wherein the ground bus insert includes a first side received in the first dielectric frame and a second side received in the second dielectric frame.

14. The receptacle connector of claim 12, wherein the ground bus insert includes an insert frame, the insert frame being dielectric and having the ground conductors on the insert frame.

15. The receptacle connector of claim 12, wherein the ground bus insert includes an insert frame, the insert frame having frame members, each frame member having a first side, a second side, and an end wall between the first and second sides, the first side rail being provided on the first side of the corresponding frame member, the second side rail being provided on the second side of the corresponding frame member, the ground conductors including connecting rails provided on the end wall of the corresponding frame members, the connecting rails electrically connecting the first and second side rails.

16. The receptacle connector of claim 12, wherein the ground conductors are plated on a dielectric insert frame of the ground bus insert.

17. The receptacle connector of claim 12, wherein the ground bus insert includes a dielectric insert frame, the insert frame having first tabs extending into the first dielectric frame and second tabs extending into the second dielectric frame, the first side rails provided on the first tabs, the second side rails provided on the second tabs, and wherein the insert frame includes first pockets between the first tabs and second pockets between the second tabs, the first tabs being aligned with the first ground contacts, the first pockets being aligned with the first signal contacts, the second tabs being aligned with the second ground contacts, the second pockets being aligned with the second signal contacts.

18. The receptacle connector of claim 12, wherein the outer housing includes a hood at a front of the outer housing, the outer housing including a loading slot open at a bottom of the outer housing, the loading slot be located rearward of the hood, the front housing being loaded into the chamber through the loading slot and being shifted forward into the hood for mating with the plug connector.

19. The receptacle connector of claim 12, wherein the outer housing includes a loading slot open at a bottom of the outer housing, the front housing being loaded into the chamber through the loading slot to a loaded position, the front housing being moved forward from the loaded position to a mating position forward of the loaded position for mating with the plug connector.

20. An electrical connector system comprising:

a plug connector having a circuit card, the circuit card having an edge extending between a first surface and a second surface, the circuit card having first plug contacts on the first surface and second plug contacts on the second surface; and a receptacle connector mated with the plug connector, the receptacle connector comprising:

a contact module assembly including a first contact module, a second contact module, and a ground bus insert, the first contact module including a first dielectric frame holding a first contact leadframe including first signal contacts and first ground contacts, the second contact module including a second dielectric frame holding a second contact leadframe including second signal contacts and second ground contacts, the first and second contact modules being stacked side by side with the ground bus insert between the first and second contact modules, the ground bus insert includes ground conductors electrically connected together, the ground conductors including first side rails and second side rails, the first side rails being electrically connected to corresponding first ground contacts, the second side rails being electrically connected to corresponding second ground contacts;

a front housing having a cavity receiving the contact module assembly, the front housing having a receptacle slot at a front of the front housing receiving the circuit card of the plug connector, the first and second signal contacts and the first and second ground contacts having mating ends received in the receptacle slot, the mating ends of the first signal contacts and the first ground contacts arranged on a first side of the receptacle slot to mate with the first plug contacts, the mating ends of the second signal contacts and the second ground contacts arranged on a second side of the receptacle slot to mate with the second plug contacts; and an outer housing having a chamber receiving the front housing, the outer housing being conductive and providing electrical shielding around the chamber.

* * * * *